US009432789B2

(12) United States Patent
Yoshizawa et al.

(10) Patent No.: US 9,432,789 B2
(45) Date of Patent: Aug. 30, 2016

(54) SOUND SEPARATION DEVICE AND SOUND SEPARATION METHOD

(71) Applicant: PANASONIC CORPORATION, Osaka (JP)

(72) Inventors: Shinichi Yoshizawa, Osaka (JP); Keizo Matsumoto, Osaka (JP); Aiko Kawanaka, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 110 days.

(21) Appl. No.: 14/275,482

(22) Filed: May 12, 2014

(65) Prior Publication Data

US 2014/0247947 A1 Sep. 4, 2014

Related U.S. Application Data

(63) Continuation of application No. PCT/JP2012/007785, filed on Dec. 5, 2012.

(30) Foreign Application Priority Data

Dec. 19, 2011 (JP) ..... 2011-276790

(51) Int. Cl.
*H04S 1/00* (2006.01)
*H04R 3/00* (2006.01)
(Continued)

(52) U.S. Cl.
CPC ..... *H04S 1/00* (2013.01); *H04R 3/005* (2013.01); *H04R 5/027* (2013.01); *H04R 2499/11* (2013.01); *H04S 3/00* (2013.01); *H04S 2400/15* (2013.01)

(58) Field of Classification Search
None
See application file for complete search history.

(56) References Cited

U.S. PATENT DOCUMENTS 6,920,223 B1 7/2005 Fosgate
6,970,567 B1 11/2005 Gundry et al.
7,162,045 B1 1/2007 Fujii
(Continued)

FOREIGN PATENT DOCUMENTS

JP 2001-069597 A 3/2001
JP 2002-044793 A 2/2002
(Continued)

OTHER PUBLICATIONS

R. Irwan and R. Aarts, "Two-to-Five Channel Sound Processing", Nov. 2002, J. Audio Eng. Soc., vol. 50, No. 11, 914-926.*

*Primary Examiner* — Jesse Elbin
*Assistant Examiner* — Kenny Truong
(74) *Attorney, Agent, or Firm* — McDermott Will & Emery LLP

(57) ABSTRACT

A sound separation device includes: a signal obtainment unit which obtains a plurality of acoustic signals including a first acoustic signal and a second acoustic signal; a differential signal generation unit which generates a differential signal that is a signal representing a difference in a time domain between the first acoustic signal and the second acoustic signal; an acoustic signal generation unit which generates, using at least one acoustic signal among the acoustic signals, a third acoustic signal; and an extraction unit which generates a frequency signal by subtracting, from a signal obtained by transforming the third acoustic signal into a frequency domain, a signal obtained by transforming the differential signal into a frequency domain, and generates a separated acoustic signal by transforming the generated frequency signal into a time domain.

11 Claims, 20 Drawing Sheets

(51) Int. Cl.
*H04R 5/027* (2006.01)
*H04S 3/00* (2006.01)

(56) References Cited

U.S. PATENT DOCUMENTS 7,760,886 B2 * 7/2010 Hellmuth ..... H04S 5/00 381/106
2008/0262834 A1 * 10/2008 Obata ..... G10L 21/028 704/200
2013/0121411 A1 * 5/2013 Robillard ..... G10L 19/008 375/240.12

FOREIGN PATENT DOCUMENTS

| | | | |
|---|---|---|---|
| JP | 2002-078100 | A | 3/2002 |
| JP | 2003-516069 | A | 5/2003 |
| JP | 2008-104240 | A | 5/2008 |
| JP | 2011-244197 | A | 12/2011 |
| WO | 2001-041504 | A1 | 6/2001 |

* cited by examiner

SOUND SEPARATION DEVICE AND SOUND SEPARATION METHOD

CROSS REFERENCE TO RELATED APPLICATION

This is a continuation application of PCT International Application No. PCT/JP2012/007785 filed on Dec. 5, 2012, designating the United States of America, which is based on and claims priority of Japanese Patent Application No. 2011-276790 filed on Dec. 19, 2011. The entire disclosures of the above-identified applications, including the specifications, drawings and claims are incorporated herein by reference in their entirety.

FIELD

The present disclosure relates to a sound separation device and a sound separation method in which two acoustic signals are used to generate an acoustic signal of a sound that is localized between reproduction positions each corresponding to a different one of the two acoustic signals.

BACKGROUND

Conventionally, a so-called (½*(L+R)) technique is known in which an L signal and an R signal that are acoustic signals (audio signals) of two channels are used to perform a linear combination on the L signal and the R signal with a scale factor+½. Use of such a technique makes it possible to obtain an acoustic signal of a sound which is localized around the center between a reproduction position where the L signal is reproduced and a reproduction position where the R signal is reproduced (for example, see patent literature (PTL) 1).

Furthermore, a technique is known in which two channel acoustic signals are used to obtain, for each frequency band, a similarity level between audio signals based on an amplitude ratio and a phase difference between the channels, and an acoustic signal is re-synthesized by multiplying a signal of a frequency band having a low similarity level by a small attenuation coefficient. Use of such a technique makes it possible to obtain an acoustic signal of a sound which is localized around the center between a reproduction position where the L signal is reproduced and a reproduction position where the R signal is reproduced (for example, see PTL 2).

With the above-described techniques, an acoustic signal that emphasizes a sound is generated which is localized around the center of the reproduction positions each corresponding to a different one of the two channel acoustic signals.

CITATION LIST

Patent Literature

[PTL 1]
Japanese Unexamined Patent Application Publication (Translation of PCT Application) No. 2003-516069
[PTL 2]
Japanese Unexamined Patent Application Publication No. 2002-78100

SUMMARY

Technical Problem

The present disclosure provides a sound separation device and a sound separation method in which two acoustic signals are used to accurately generate an acoustic signal of a sound which is localized between the reproduction positions each corresponding to a different one of the two acoustic signals.

Solution to Problem

A sound separation device according to an aspect of the present disclosure includes: a signal obtainment unit configured to obtain a plurality of acoustic signals including a first acoustic signal and a second acoustic signal, the first acoustic signal representing a sound outputted from a first position, and the second acoustic signal representing a sound outputted from a second position; a differential signal generation unit configured to generate a differential signal which is a signal representing a difference in a time domain between the first acoustic signal and the second acoustic signal; an acoustic signal generation unit configured to generate, using at least one acoustic signal among the acoustic signals, a third acoustic signal including a component of a sound which is localized in a predetermined position between the first position and the second position by the sound outputted from the first position and the sound outputted from the second position; and an extraction unit configured to generate a third frequency signal by subtracting, from a first frequency signal obtained by transforming the third acoustic signal into a frequency domain, a second frequency signal obtained by transforming the differential signal into a frequency domain, and generate a separated acoustic signal by transforming the generated third frequency signal into a time domain, the separated acoustic signal being an acoustic signal for outputting a sound localized in the predetermined position.

It should be noted that the herein disclosed subject matter can be realized not only as a sound separation device, but also as: a sound separation method; a program describing the method; or a non-transitory computer-readable recording medium, such as a compact disc read-only memory (CD-ROM), on which the program is recorded.

Advantageous Effects

With a sound separation device or the like according to the present disclosure, it is possible to accurately generate, using two acoustic signals, an acoustic signal of a sound which is localized between the reproduction positions each corresponding to a different one of the two acoustic signals.

BRIEF DESCRIPTION OF DRAWINGS

These and other objects, advantages and features of the present disclosure will become apparent from the following description thereof taken in conjunction with the accompanying drawings that illustrate a specific embodiment of the present disclosure.

Figure 1:
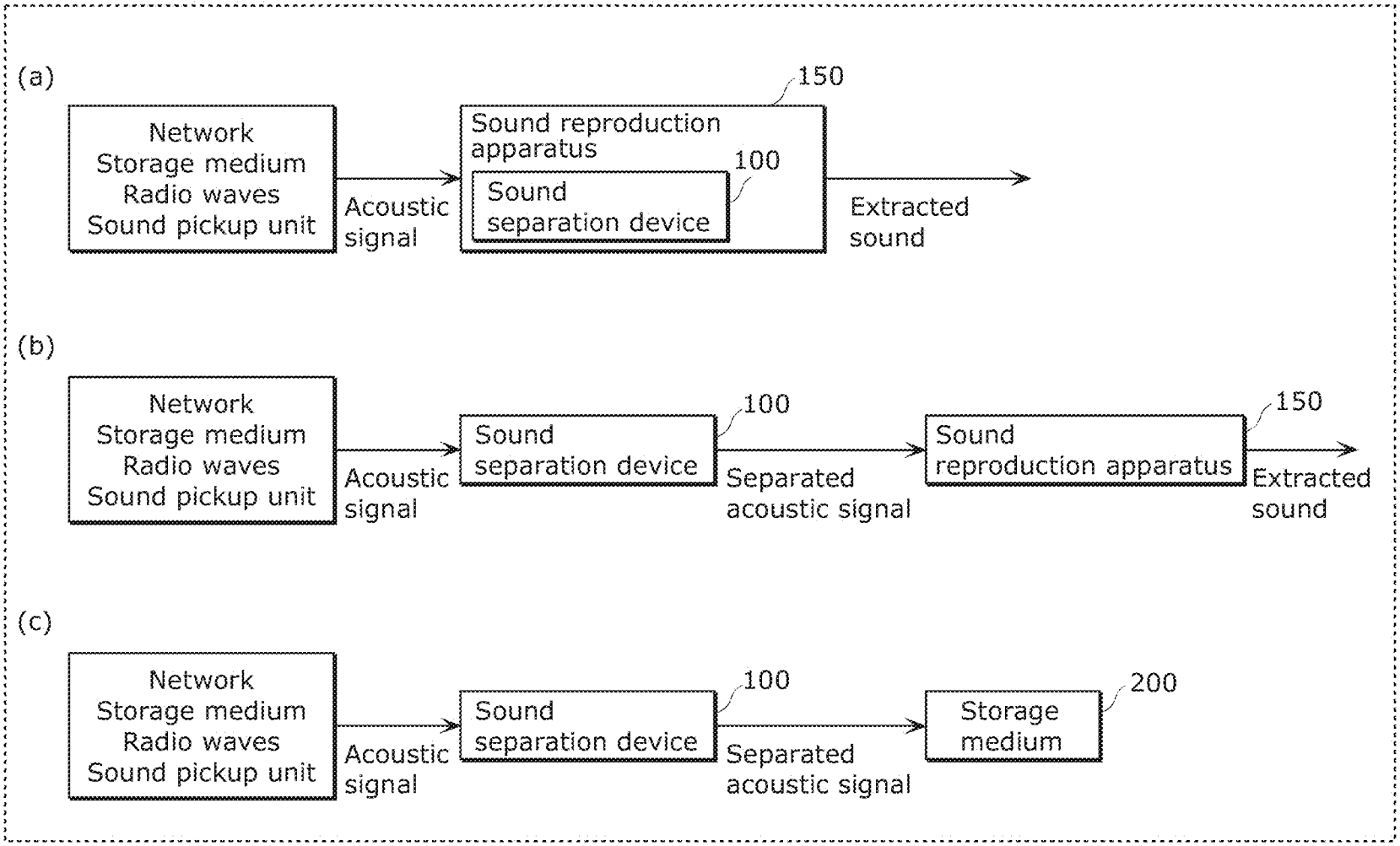
FIG. 1 shows diagrams showing examples of a configuration of a sound separation device and a peripheral apparatus according to Embodiment 1.

DESCRIPTION OF EMBODIMENTS (Underlying Knowledge Forming Basis of the Present Disclosure)

As described in the Background section, PTL 1 and PTL 2 disclose a technique in which an acoustic signal which emphasizes a sound localized between reproduction positions each corresponding to a different one of two channel acoustic signals.

According to a method based on a technical idea similar to the technical idea in PTL 1, the generated acoustic signal includes: a sound component localized in a position on an L signal-side; and a sound component localized in a position on an R signal-side. Thus, a sound component localized in a center cannot be accurately extracted from the sound component localized on the L signal-side and the sound component localized on the R signal-side, which is problematic.

Furthermore, according to a method based on a technical idea similar to the technical idea in PTL 2, in the case where sound components localized in a plurality of directions are mixed, values of an amplitude ratio and a phase difference also results from mixtures of the sound components. This results in a decrease in a similarity level of a sound component localized in the center. Therefore, the sound component localized in the center cannot be accurately extracted from the sound component localized in a direction different from the center, which is problematic.

In this manner, according to the methods based on the above-described conventional technical ideas, a sound component localized in a specific position cannot be accurately extracted from sound components included in a plurality of acoustic signals, which is problematic.

In order to solve the above problems, a sound separation device according to an aspect of the present disclosure includes: a signal obtainment unit configured to obtain a plurality of acoustic signals including a first acoustic signal and a second acoustic signal, the first acoustic signal representing a sound outputted from a first position, and the second acoustic signal representing a sound outputted from a second position; a differential signal generation unit configured to generate a differential signal which is a signal representing a difference in a time domain between the first acoustic signal and the second acoustic signal; an acoustic signal generation unit configured to generate, using at least one acoustic signal among the acoustic signals, a third acoustic signal including a component of a sound which is localized in a predetermined position between the first position and the second position by the sound outputted from the first position and the sound outputted from the second position; and an extraction unit configured to generate a third frequency signal by subtracting, from a first frequency signal obtained by transforming the third acoustic signal into a frequency domain, a second frequency signal obtained by transforming the differential signal into a frequency domain, and generate a separated acoustic signal by transforming the generated third frequency signal into a time domain, the separated acoustic signal being an acoustic signal for outputting a sound localized in the predetermined position.

In this manner, the separated acoustic signal that is the acoustic signal of the sound localized in the predetermined position can be accurately generated by subtracting, from the third acoustic signal, the differential signal in the frequency domain.

Furthermore, for example, when a distance from the predetermined position to the first position is shorter than a distance from the predetermined position to the second position, the acoustic signal generation unit may use the first acoustic signal as the third acoustic signal.

With this, the third acoustic signal is generated which includes a small sound component of the second acoustic signal greatly distanced from the predetermined position, and thus the separated acoustic signal can be more accurately generated.

Furthermore, for example, when a distance from the predetermined position to the second position is shorter than a distance from the predetermined position to the first position, the acoustic signal generation unit may use the second acoustic signal as the third acoustic signal.

With this, the third acoustic signal is generated which includes a small sound component of the first acoustic signal greatly distanced from the predetermined position, and thus the separated acoustic signal can be more accurately generated.

Furthermore, for example, the acoustic signal generation unit may determine a first coefficient and a second coefficient, and generate the third acoustic signal by adding a signal obtained by multiplying the first acoustic signal by the first coefficient and a signal obtained by multiplying the second acoustic signal by the second coefficient, the first coefficient being a value which increases with a decrease in a distance from the predetermined position to the first position, and the second coefficient being a value which increases with a decrease in a distance from the predetermined position to the second position.

With this, the third acoustic signal is generated which corresponds to the predetermined position, and thus the separated acoustic signal can be more accurately generated.

Furthermore, for example, the differential signal generation unit may generate the difference signal which is a difference in a time domain between a signal obtained by multiplying the first acoustic signal by a first weighting coefficient and a signal obtained by multiplying the second acoustic signal by a second weighting coefficient, and determine the first weighting coefficient and the second weighting coefficient so that a value obtained by dividing the second weighting coefficient by the first weighting coefficient increases with a decrease in a distance from the first position to the predetermined position.

In this manner, the separated acoustic signal corresponding to the predetermined position can be accurately generated with the first weighting coefficient and the second weighting coefficient.

Furthermore, for example, it may be that a localization range of a sound outputted using the separated acoustic signal increases with a decrease in absolute values of the first weighting coefficient and the second weighting coefficient determined by the differential signal generation unit, and a localization range of a sound outputted using the separated acoustic signal decreases with an increase in absolute values of the first weighting coefficient and the second weighting coefficient determined by the differential signal generation unit.

In other words, the localization range of the sound outputted using the separated acoustic signal can be adjusted with the absolute value of the first weighting coefficient and the absolute value of the second weighting coefficient.

Furthermore, for example, the extraction unit may generate the third frequency signal by using a subtracted value which is obtained for each frequency by subtracting a magnitude of the second frequency signal from a magnitude of the first frequency signal, and the subtracted value may be replaced with a predetermined positive value when the subtracted value is a negative value.

Furthermore, for example, the sound separation device may further include a sound modification unit which generates a modification acoustic signal using at least one acoustic signal among the acoustic signals, and adds the modification acoustic signal to the separated acoustic signal, the modification acoustic signal being for modifying the separated acoustic signal according to the predetermined position.

Furthermore, for example, the sound modification unit may determine a third coefficient and a fourth coefficient, and generate the modification acoustic signal by adding a signal obtained by multiplying the first acoustic signal by the third coefficient and a signal obtained by multiplying the second acoustic signal by the fourth coefficient, the third coefficient being a value which increases with a decrease in a distance from the predetermined position to the first position, and the fourth coefficient being a value which increases with a decrease in a distance from the predetermined position to the second position.

With this, a sound component (modification acoustic signal) localized around the predetermined position is added to the separated acoustic signal for modification. This makes it possible to spatially smoothly connect sounds which are outputted using the separated acoustic signals so as to avoid creation of a space where no sound is localized.

Furthermore, for example, the first acoustic signal and the second acoustic signal may form a stereo signal.

A sound separation method according to an aspect of the present disclosure includes: obtaining a plurality of acoustic signals including a first acoustic signal and a second acoustic signal, the first acoustic signal representing a sound outputted from a first position, and the second acoustic signal representing a sound outputted from a second position; generating a differential signal which is a signal representing a difference in a time domain between the first acoustic signal and the second acoustic signal; generating, using at least one acoustic signal among the acoustic signals, a third acoustic signal including a component of a sound which is localized in a predetermined position between the first position and the second position by the sound outputted from the first position and the sound outputted from the second position; and generating a third frequency signal by subtracting, from a first frequency signal obtained by transforming the third acoustic signal into a frequency domain, a second frequency signal obtained by transforming the differential signal into a frequency domain, and generating a separated acoustic signal by transforming the generated third frequency signal into a time domain, the separated acoustic signal being an acoustic signal for outputting a sound localized in the predetermined position.

These general and specific aspects may be implemented using a system, a method, an integrated circuit, a computer program, or a computer-readable recording medium, such as a CD-ROM, or any combination of systems, methods, integrated circuits, computer programs, or computer-readable recording media.

The following describes embodiments of a sound separation device according to the present disclosure in detail with reference to drawings. Note that, details beyond necessity are sometimes omitted. For example, detailed descriptions of matters which are already well known or a repeated description for a substantially the same configuration may be omitted. This is to avoid making the following description to be unnecessarily redundant, and to facilitate the understanding of those skilled in the art.

It should be noted that the inventors provide the attached drawings and the following description to enable those skilled in the art to sufficiently understand the present disclosure, and do not intend to limit a subject matter described in the CLAIMS by such drawings and the description.

Embodiment 1

First, an application example of a sound separation device according to this embodiment is described.

FIG. 1 shows diagrams showing examples of a configuration of a sound separation device and a peripheral apparatus according to this embodiment.

A sound separation device according to this embodiment (e.g., a sound separation device 100 according to Embodiment 1) is, for example, realized as a part of a sound reproduction apparatus, as shown in (a) in FIG. 1.

The sound separation device 100 extracts an extraction-target sound component by using an obtained acoustic signal, and generates a separated acoustic signal which is an acoustic signal representing an extracted sound component (extracted sound). The extracted sound is outputted when the above-described separated acoustic signal is reproduced using a reproduction system of a sound reproduction apparatus 150 which includes the sound separation device 100.

In this case, examples of the sound reproduction apparatus 150 include: audio equipment such as portable audio equipment or the like which includes a speaker; a mini-component; audio equipment, such as an AV center amplifier, or the like, to which a speaker is connected; a television, a digital still camera, a digital video camera, a portable terminal device, a personal computer, a television conference system, a speaker, a speaker system, and so on.

Furthermore, for example, as shown in (b) in FIG. 1, the sound separation device 100 uses the obtained acoustic signal to extract an extraction-target sound component, and generates a separated acoustic signal which represents the extracted sound component. The sound separation device 100 transmits the above-described separated acoustic signal to the sound reproduction apparatus 150 which is separately provided from the sound separation device 100. The separated acoustic signal is reproduced using a reproduction system of the sound reproduction apparatus 150, and thus the extracted sound is outputted.

In this case, the sound separation device 100 is realized, for example, as a server and a relay for a network audio or the like, portable audio equipment, a mini-component, an AV center amplifier, a television, a digital still camera, a digital video camera, a portable terminal device, a personal computer, a television conference system, a speaker, a speaker system, or the like.

Furthermore, for example, as shown in (c) in FIG. 1, the sound separation device 100 uses the obtained acoustic signal to extract an extraction-target sound component, and generates a separated acoustic signal which represents the extracted sound component. The sound separation device 100 stores in or transmits to a storage medium 200 the above-described separated acoustic signal.

Examples of the storage medium 200 include: a hard disk, a package media such as a Blu-ray Disc, a digital versatile disc (DVD), a compact disc (CD), or the like; a flash memory; and so on. Furthermore, the storage medium 200 such as the hard disk, the flash memory, or the like may be a storage medium included in a server and a relay for a network audio or the like, portable audio equipment, a mini-component, an AV center amplifier, a television, a digital still camera, a digital video camera, a portable terminal device, a personal computer, a television conference system, a speaker, a speaker system, or the like.

As described above, the sound separation device according to this embodiment may have any configuration including a function for obtaining an acoustic signal and extracting a desired sound component from the obtained acoustic signal.

Figure 2:
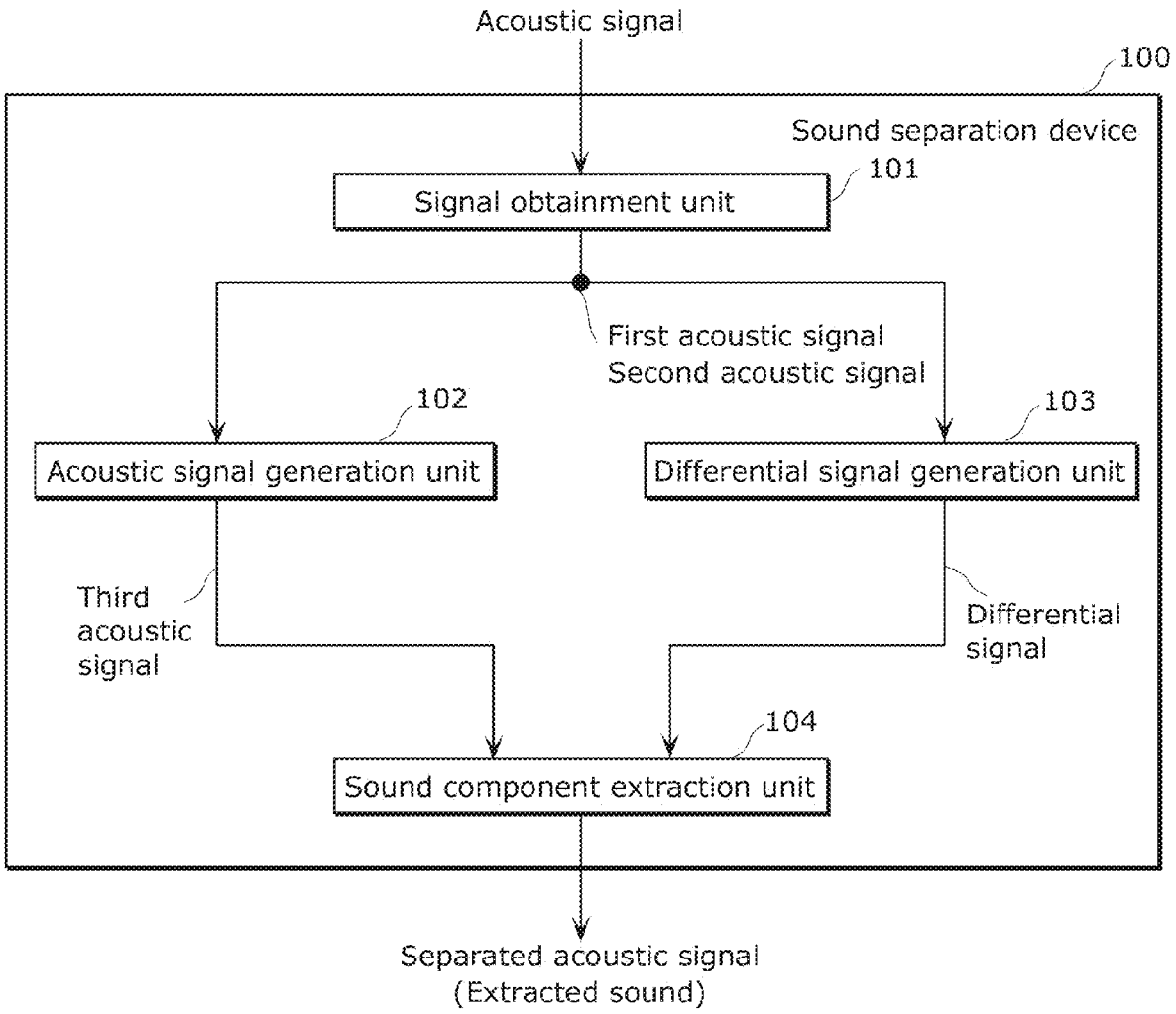
FIG. 2 is a functional block diagram showing a configuration of the sound separation device according to Embodiment 1.
Figure 3:
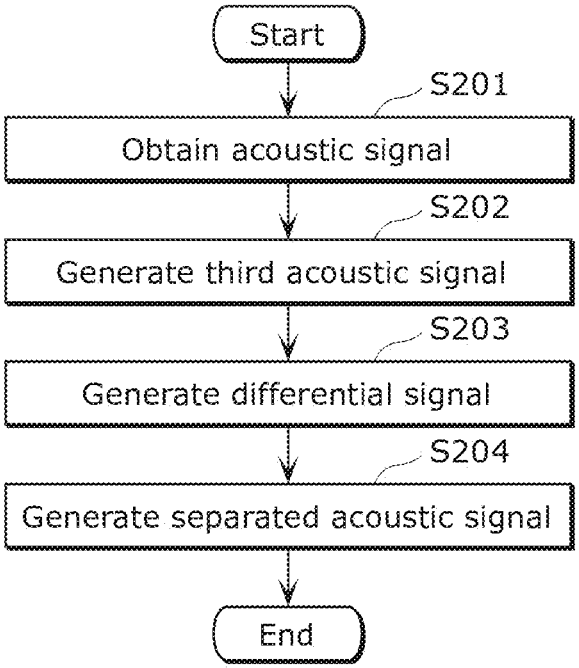
FIG. 3 is a flowchart showing operations performed by the sound separation device according to Embodiment 1.

The following describes a specific configuration and an outline of operations of the sound separation device 100, using FIG. 2 and FIG. 3.

FIG. 2 is a functional block diagram showing a configuration of the sound separation device 100 according to Embodiment 1.

FIG. 3 is a flowchart showing operations performed by the sound separation device 100.

As shown in FIG. 2, the sound separation device 100 includes: a signal obtainment unit 101, an acoustic signal generation unit 102, a differential signal generation unit 103, and a sound component extraction unit 104.

The signal obtainment unit 101 obtains a plurality of acoustic signals including a first acoustic signal which is an acoustic signal corresponding to a first position, and a second acoustic signal which is an acoustic signal corresponding to a second position (S201 in FIG. 3). The first acoustic signal and the second acoustic signal include the same sound component. More specifically, for example, this means that when the first acoustic signal includes a sound component of castanets, a sound component of a vocal, and a sound component of a piano, the second acoustic signal also includes the sound component of the castanets, the sound component of the vocal, and the sound component of the piano.

The acoustic signal generation unit 102 generates, using at least one acoustic signal among the acoustic signals obtained by the signal obtainment unit 101, a third acoustic signal which is an acoustic signal including a sound component of an extraction-target sound (S202 in FIG. 3). Details of a method for generating the third acoustic signal will be described later.

The differential signal generation unit 103 generates a differential signal which is a signal representing a difference in the time domain between the first acoustic signal and the second acoustic signal among the acoustic signals obtained by the signal obtainment unit 101 (S203 in FIG. 3). Details of a method for generating the differential signal will be described later.

The sound component extraction unit 104 subtracts, from a signal obtained by transforming the third acoustic signal into the frequency domain, a signal obtained by transforming the differential signal into the frequency domain. The sound component extraction unit 104 generates a separated acoustic signal which is an acoustic signal obtained by transforming the signal resulting from the subtraction into the time domain (S204 in FIG. 3). An extraction-target sound, which is localized by the first acoustic signal and the second acoustic signal, is outputted as the extracted sound when the separated acoustic signal is reproduced. In other words, the sound component extraction unit 104 can extract the extraction-target sound.

Figure 4:
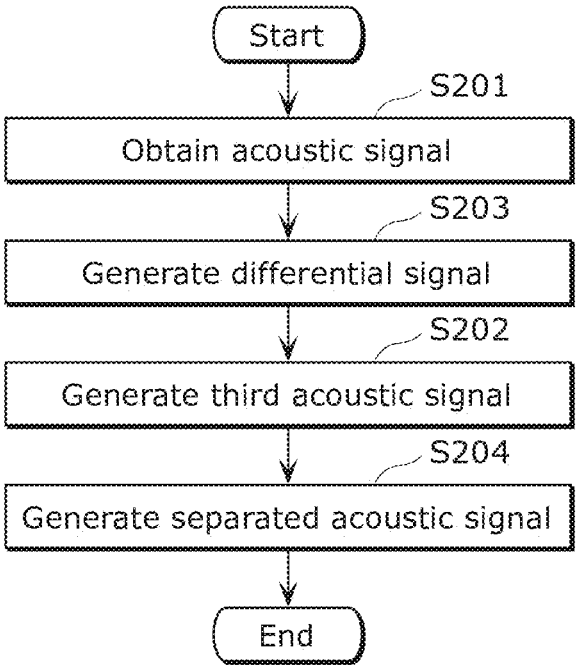
FIG. 4 is another flowchart showing operations performed by the sound separation device according to Embodiment 1.

It should be noted that the order of operations performed by the sound separation device 100 is not limited to the order shown by the flowchart in FIG. 3. For example, as shown in FIG. 4, the order of operations of step S202 in which the third acoustic signal is generated and step S203 in which a differential signal is generated may be a reverse of the order shown by the flowchart in FIG. 3. Furthermore, step S202 and step S203 may be performed in parallel.

Next, details of operations performed by a sound separation device are described.

It should be noted that the following describes, as an example, the case in which the sound separation device 100 obtains two acoustic signals, namely, a first acoustic signal corresponding to a first position and a second acoustic signal corresponding to a second position, and extracts a sound component localized between the first position and the second position.

(Regarding Operations for Obtaining Acoustic Signal)

The following describes details of operations performed by the signal obtainment unit 101 to obtain an acoustic signal.

As already described using FIG. 1, the signal obtainment unit 101 obtains an acoustic signal from, for example, a network such as the Internet or the like. Furthermore, for example, the signal obtainment unit 101 obtains an acoustic signal from a package media such as a hard disk, a Blu-ray Disc, a DVD, a CD, or the like, or a storage medium such as a flash memory, or the like.

Furthermore, for example, the signal obtainment unit 101 obtains an acoustic signal from radio waves of a television, a mobile phone, a wireless network, or the like. Furthermore, for example, the signal obtainment unit 101 obtains an acoustic signal of a sound which is picked up from a sound pickup unit of a smartphone, an audio recorder, a digital still camera, a digital video camera, a personal computer, a microphone, or the like.

Stated differently, the acoustic signal may be obtained through any route as long as the signal obtainment unit 101 can obtain the first acoustic signal and the second acoustic signal which represent the identical sound field.

Typically, the first acoustic signal and the second acoustic signal are an L signal and an R signal which form a stereo signal. In this case, the first position and the second position are respectively a predetermined position where an L channel speaker is disposed and a predetermined position where an R channel speaker is disposed. The first acoustic signal and the second acoustic signal may be two channel acoustic signals, for example, selected from 5.1 channel acoustic signals. In this case, the first position and the second position are predetermined positions in each of which a different one of the selected two channel speakers are arranged.

(Regarding Operations for Generating Third Acoustic Signal)

The following describes details of operations performed by the acoustic signal generation unit 102 to generate the third acoustic signal.

The acoustic signal generation unit 102 generates, using at least one acoustic signal among the acoustic signals obtained by the signal obtainment unit 101, the third acoustic signal which corresponds to a position where an extraction-target sound is localized.

The following specifically describes a method for generating the third acoustic signal.

Figure 5:
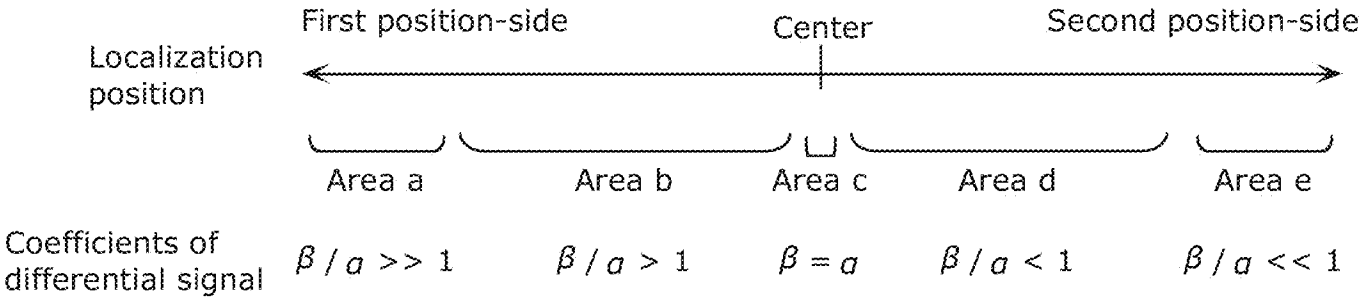
FIG. 5 is a conceptual diagram showing a localization position of an extraction-target sound.

FIG. 5 is a conceptual diagram showing a localization position of an extraction-target sound.

In this embodiment, the extraction-target sound is a sound localized in an area between the first position (first acoustic signal) and the second position (second acoustic signal). As shown in FIG. 5, the area is separated into five areas, namely, an area a to an area e, for descriptive purposes.

More specifically, it is assumed that an area closest to a side of a first position is an "area a", an area closest to a second position is an "area e", an area around the center between the first position and the second position is "area c", an area between the area a and the area c is an "area b", and an area between the area c and the area e is an "area d".

The method for generating the third acoustic signal according to this embodiment includes the three specific cases shown below.

1. The case in which a third acoustic signal is generated from the first acoustic signal.

2. The case in which a third acoustic signal is generated from the second acoustic signal.

3. The case in which a third acoustic signal is generated using both the first acoustic signal and the second acoustic signal.

When sounds localized in the area a and the area b are extracted among sounds represented by the first acoustic signal and the second acoustic signal, the acoustic signal generation unit 102 uses, as the third acoustic signal, the first acoustic signal itself. This is because the area a and the area b are areas closer to the first position than to the second position, and thus the generation of the third acoustic signal, which includes a large sound component of the first acoustic signal and a small sound component of the second acoustic signal, enables the sound component extraction unit 104 to more accurately extract an extraction-target sound component.

Furthermore, when a sound localized in the area c is extracted, the acoustic signal generation unit 102 uses, as the third acoustic signal, an acoustic signal which is generated by adding the first acoustic signal and the second acoustic signal. In this manner, when the first acoustic signal and the second acoustic signal in phase with each other are added, the third acoustic signal is generated in which the sound component localized in the area c is pre-emphasized. This makes it possible for the sound component extraction unit 104 to more accurately extract the extraction-target sound component.

In addition, when the sound localized in the area d and the area e are extracted, the acoustic signal generation unit 102 uses, as the third acoustic signal, the second acoustic signal itself. The area d and the area e are areas closer to the second position than to the first position, and thus generation of the third acoustic signal, which includes a large sound component of the second acoustic signal and a small sound component of the first acoustic signal, enables the sound component extraction unit 104, which will be described later, to more accurately extract the extraction-target sound component.

It should be noted that the acoustic signal generation unit 102 may generate the third acoustic signal by performing a weighted addition on the first acoustic signal and the second acoustic signal. More specifically, the acoustic signal generation unit 102 may generate the third acoustic signal by adding a signal obtained by multiplying the first acoustic signal by a first coefficient and a signal obtained by multiplying the second acoustic signal by a second coefficient. Here, each of the first coefficient and the second coefficient is a real number greater than or equal to zero.

For example, when the sounds localized in the area a and the area b are extracted, since the area a and the area b are areas closer to the first position than to the second position, the acoustic signal generation unit 102 may generate the third acoustic signal using a first coefficient and a second coefficient which has a smaller value than the first coefficient. In this manner, the third acoustic signal including a large sound component of the first acoustic signal and a small sound component of the second acoustic signal is generated. This makes it possible for the sound component extraction unit 104 to more accurately extract the extraction-target sound component.

Furthermore, for example, when the sounds localized in the area d and the area e are extracted, since the area d and the area e are areas closer to the second position than to the first position, the acoustic signal generation unit 102 may generate the third acoustic signal using a first coefficient and a second coefficient which has a greater value than the first coefficient. In this manner, the third acoustic signal is generated which includes a large sound component of the second acoustic signal and a small sound component of the first acoustic signal. This makes it possible for the sound component extraction unit 104 to more accurately extract the extraction-target sound component.

It should be noted that no matter which of the above-described methods is used to generate the third acoustic signal, the sound separation device 100 can extract the extraction-target sound component. Stated differently, it is sufficient that the third acoustic signal include the extraction-target sound component. This is because an unnecessary portion of the third acoustic signal is removed using a differential signal which will be described later.

(Regarding Operations for Generating Differential Signal)

The following describes details of operations performed by the differential signal generation unit 103 to generate a differential signal.

The differential signal generation unit 103 generates the differential signal which represents a difference in the time domain between the first acoustic signal and the second acoustic signal that are obtained by the signal obtainment unit 101.

In this embodiment, the differential signal generation unit 103 generates the differential signal by performing a weighted subtraction on the first acoustic signal and the second acoustic signal. More specifically, the differential signal generation unit 103 generates the differential signal by performing subtraction on a signal obtained by multiplying the first acoustic signal by a first weighting coefficient $\alpha$ and a signal obtained by multiplying the second acoustic signal by a second weighting coefficient $\beta$. More specifically, the differential signal generation unit 103 generates the differential signal by using an (Expression 1) shown below. It should be noted that each of $\alpha$ and $\beta$ is a real number greater than or equal to zero.

$$\text{Differential signal}=\alpha\times\text{first acoustic signal}-\beta\times\text{second acoustic signal} \quad \text{(Expression 1)}$$

FIG. 5 shows relationships between a value of the first weighting coefficient $\alpha$ and a value of the second weighting coefficient $\beta$ which are respectively used when extracting a sound localized in one of the areas from area a to the area e. With a decrease in the distance from the position where the extraction-target sound is localized to the first position, the first weighting coefficient $\alpha$ increases and the second weighting coefficient $\beta$ decreases. Furthermore, with a decrease in the distance from the position where the extraction-target sound is localized to the second position, the first weighting coefficient $\alpha$ decreases and the second weighting coefficient $\beta$ increases.

It should be noted that although the second acoustic signal is subtracted from the first acoustic signal in (Expression 1), the first acoustic signal may be subtracted from the second acoustic signal. The reason for this is that the sound component extraction unit 104 subtracts the differential signal from the third acoustic signal in the frequency domain. In this case, as for FIG. 5, interpretation may be made by reversing the description of the first acoustic signal and the second acoustic signal.

When the sound localized in the area a is extracted, the differential signal generation unit 103 determines the values of the coefficients so that the second weighting coefficient $\beta$ is significantly greater than the first weighting coefficient $\alpha$ ($\beta/\alpha>>1$), and generates the differential signal by using (Expression 1). With this, the sound component extraction unit 104, which will be described later, can mainly remove, from the third acoustic signal, the sound component which is localized on the second position-side and included in the third acoustic signal.

It should be noted that, when the sound localized in the area a is extracted, the differential signal generation unit 103 may set the first weighting coefficient $\alpha=0$, and generate the second acoustic signal itself as the differential signal.

Furthermore, when the sound localized in the area b is extracted, the differential signal generation unit 103 sets the values of the coefficients so that the second weighting coefficient $\beta$ is relatively greater than the first weighting coefficient $\alpha$($\beta/\alpha=1$), and generates the differential signal by using (Expression 1). With this, the sound component extraction unit 104 can remove in a balanced manner, from the third acoustic signal, the sound component localized on the first position-side and the sound component localized on the second position-side which are included in the third acoustic signal.

Furthermore, when the sound localized in the area c is extracted, the differential signal generation unit 103 sets the values of the coefficients so that the first weighting coefficient $\alpha$ equals to the second weighting coefficient $\beta$ ($\beta/\alpha=1$), and generates the differential signal using (Expression 1). With this, the sound component extraction unit 104 can evenly remove, from the third acoustic signal, the sound component localized on the first position-side and the sound component localized on the second position-side which are included in the third acoustic signal.

Furthermore, when the sound localized in the area d is extracted, the differential signal generation unit 103 sets the values of the coefficients so that the first weighting coefficient $\alpha$ is relatively greater than the second weighting coefficient $\beta$ ($\beta/\alpha<1$), and generates the differential signal using (Expression 1). With this, the sound component extraction unit 104 can remove in a balanced manner, from the third acoustic signal, the sound component localized on the first position-side and the sound component localized on the second position-side which are included in the third acoustic signal.

Furthermore, when the sound localized in the area e is extracted, the differential signal generation unit 103 determines the values of the coefficients so that the first weighting coefficient $\alpha$ is significantly greater than the second weighting coefficient $\beta$($\beta/\alpha<<1$), and generates the differential signal using (Expression 1). With this, the sound component extraction unit 104 can mainly remove, from the third acoustic signal, the sound component which is localized on the first position-side and included in the third acoustic signal.

It should be noted that, when the sound localized in the area e is extracted, the differential signal generation unit 103 may set the second weighting coefficient $\beta=0$, and generate the first acoustic signal itself as the differential signal.

In this manner, in this embodiment, the differential signal generation unit 103 determines the ratio of the first weighting coefficient $\alpha$ and the second weighting coefficient $\beta$ according to the localization position of the extraction-target sound. This makes it possible for the sound separation device 100 to extract the sound component in a desired localization position.

It should be noted that the differential signal generation unit 103 determines the absolute values of the first weighting coefficient $\alpha$ and the second weighting coefficient $\beta$ according to a localization range of the extraction-target sound. The localization range refers to a range where a listener can perceive a sound image (a range in which a sound image is localized).

Figure 6:
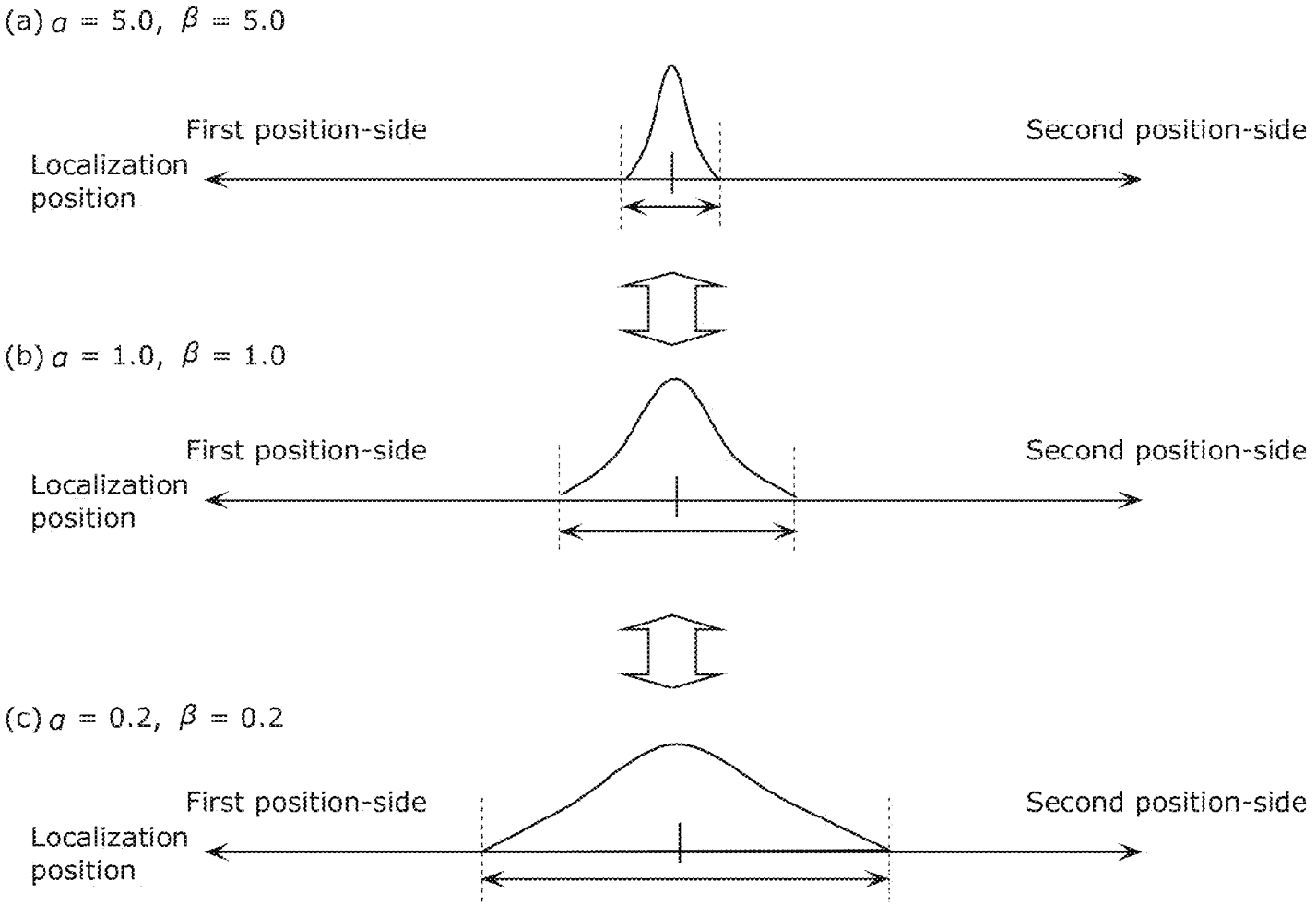
FIG. 6 shows schematic diagrams each showing a relationship between magnitudes of the absolute values of weighting coefficients and a localization range of an extracted sound.

FIG. 6 shows schematic diagrams each showing a relationship between magnitudes of the absolute values of weighting coefficients and a localization range of an extracted sound.

In FIG. 6, the top-bottom direction (vertical axis) of the diagram represents the magnitude of a sound pressure of the extracted sound, and the left-right direction (horizontal axis) of the diagram represents the localization range.

As shown in FIG. 6, with an increase in the absolute values of the first weighting coefficient α and the second weighting coefficient β, a localization range of the extracted sound decreases.

(b) in FIG. 6 shows a state where α=β=1.0. When the differential signal generation unit 103 determines the absolute values of the first weighting coefficient α and the second weighting coefficient β to be (e.g., α=β=5.0) greater than the coefficients shown in (b) in FIG. 6, the localization range of the extracted sound decreases as shown in (a) in FIG. 6.

In a similar manner, when the differential signal generation unit 103 determines the absolute values of the first weighting coefficient α and the second weighting coefficient β to be (e.g., α=β=0.2) smaller than the coefficients shown in (b) in FIG. 6, the localization range of the extracted sound increases as shown in (c) in FIG. 6.

As described above, the differential signal generation unit 103 determines the ratio of the first weighting coefficient α and the second weighting coefficient β according to the localization position of the extraction-target sound, and determines the absolute values of the first weighting coefficient α and the second weighting coefficient β according to the localization range of the extraction-target sound. Stated differently, the differential signal generation unit 103 can adjust the localization position and the localization range of the extraction-target sound with the first weighting coefficient α and the second weighting coefficient β. With this, the sound separation device 100 can accurately extract the extraction-target sound.

It should be noted that the differential signal generation unit 103 may generate the differential signal by performing subtraction on values obtained by applying exponents to amplitudes (e.g., amplitude to the power of three, amplitude to the power of 0.1) of the signals, namely, the first acoustic signal and the second acoustic signal. More specifically, the differential signal generation unit 103 may generate the differential signal by performing subtraction on the physical quantities which represent different magnitudes obtained by transforming the first acoustic signal and the second acoustic signal while maintaining the magnitude relationship of amplitudes.

It should be noted that, when the acoustic signals of the sounds picked up from a pickup unit such as a microphone or the like is used as the first acoustic signal and the second acoustic signal, the differential signal generation unit 103 may generate the subtraction signal by making adjustment so that the extraction-target sounds included in the first acoustic signal and the second acoustic signal are of an identical time point, and then subtracting the second acoustic signal from the first acoustic signal. The following is an example of a method for adjusting the time point. Relative time points at which an extraction-target sound is physically inputted to a first microphone and a time point at which an extraction-target sound is physically inputted to a second microphone can be obtained based on a position where the extraction-target sound is localized, a position of the first microphone which picked up the first acoustic signal, a position of the second microphone which picked up the second acoustic signal, and a speed of sound. Thus, the time point can be adjusted by correcting the relative time points.

(Regarding Operations for Extracting Sound Component)

The following describes details of operations performed by the sound component extraction unit 104 to extract a sound component.

First, the sound component extraction unit 104 obtains a first frequency signal that is a signal obtained by transforming the third acoustic signal, which is generated by the acoustic signal generation unit 102, into the frequency domain. In addition, the sound component extraction unit 104 obtains a second frequency signal that is a signal obtained by transforming the differential signal, which is generated by the differential signal generation unit 103, into the frequency domain.

In this embodiment, the sound component extraction unit 104 performs the transformation into the above-described frequency signal by a fast Fourier transform. More specifically, the sound component extraction unit 104 performs the transformation with analysis conditions described below.

The sampling frequency of the first acoustic signal and the second acoustic signal is 44.1 kHz. Then, the sampling frequency of the generated third acoustic signal and the differential signal is 44.1 kHz. A window width of the fast Fourier transform is 4096 pt, and a Hanning window is used. Furthermore, a frequency signal is obtained by shifting a time axis every 512 pt to transform the frequency signal into a signal in the time domain as described later.

Subsequently, the sound component extraction unit 104 subtracts a second frequency signal from a first frequency signal. It should be noted that the frequency signal obtained by the subtraction operation is used as the third frequency signal.

In this embodiment, the sound component extraction unit 104 divides frequency signals, which are obtained by the fast Fourier transform, into the magnitude and phase of the frequency signal, and perform subtraction on the magnitudes of the frequency signals for each frequency component. More specifically, the sound component extraction unit 104 subtracts, from the magnitude of the frequency signal of the third acoustic signal, the magnitude of the frequency signal of the differential signal for each frequency component. The sound component extraction unit 104 performs the above-described subtraction at time intervals of shifting of the time axis used when obtaining the frequency signal, that is, for every 512 pt. It should be noted that, in this embodiment, the amplitude of the frequency signal is used as the magnitude of the frequency signal.

At this time, when a negative value is obtained by the subtraction operation, the sound component extraction unit 104 handles the subtraction result as a predetermined positive value significantly close to zero, that is, approximately zero. This is because an inverse fast Fourier transform, which will be described later, is performed on the third frequency signal obtained by the subtraction operation. The result of the subtraction is used as the magnitude of the frequency signal of respective frequency components of the third frequency signal.

It should be noted that, in this embodiment, as the phase of the third frequency signal, the phase of the first frequency signal (the frequency signal obtained by transforming the third acoustic signal into the frequency domain) is used as it is.

In this embodiment, when the sounds localized in the area a and the area b are extracted, the first acoustic signal is used as the third acoustic signal, and thus the phase of the frequency signal, which is obtained by transforming the first acoustic signal into the frequency domain, is used as the phase of the third frequency signal.

Furthermore, in this embodiment, when the sound localized in the area c is extracted, the acoustic signal obtained by adding the first acoustic signal and the second acoustic signal is used as the third acoustic signal, and thus the phase of the frequency signal, which is obtained by transforming the acoustic signal obtained by the adding operation, is used as the phase of the third frequency signal.

Furthermore, in this embodiment, when the sounds localized in the area d and the area e are extracted, the second acoustic signal is used as the third acoustic signal, and thus the phase of the frequency signal, which is obtained by transforming the second acoustic signal into the frequency domain, is used as the phase of the third frequency signal.

In this manner, in generating the third frequency signal, it is possible to reduce the operation amount performed by the sound component extraction unit 104 by avoiding operations on the phase, and using the phase of the first frequency signal as it is.

Then, the sound component extraction unit 104 transforms the third frequency signal into a signal in the time domain that is the acoustic signal. In this embodiment, the sound component extraction unit 104 transforms the third frequency signal into the acoustic signal in the time domain (separated acoustic signal) by an inverse fast Fourier transform.

In this embodiment, as described above, the window width of the fast Fourier transform is 4096 pt, and the time shift width is smaller than the window width and is 512 pt. More specifically, the third frequency signal includes an overlap portion in the time domain. With this, when the third frequency signal is transformed into the acoustic signal in the time domain by the inverse fast Fourier transform, continuity of the acoustic signal in the time domain can be smoothen by averaging candidates of time waveforms at the identical time point.

The extracted sound is outputted by the reproduction of the separated acoustic signal which is generated by the sound component extraction unit 104 as described above.

It should be noted that, when the second frequency signal is subtracted from the first frequency signal, instead of performing subtraction on amplitudes of frequency signals for each frequency component, the sound component extraction unit 104 may perform, for each frequency component, subtraction on the powers of the frequency signals (amplitudes to the powers of two), on the values obtained by applying exponents to the amplitudes (e.g., amplitude to the power of three, amplitude to the power of 0.1) of the frequency signals, or on amounts which represent other magnitudes obtained by transformation while maintaining a magnitude relationship of amplitudes.

Furthermore, the sound component extraction unit 104 may, when the second frequency signal is subtracted from the first frequency signal, perform subtraction after multiplying each of the first frequency signal and the second frequency signal by a corresponding coefficient.

It should be noted that although the fast Fourier transform is used when the frequency signal is generated in this embodiment, another ordinary frequency transform may be used, such as a discrete cosine transform, a wavelet transform, or the like. In other words, any method may be used that transforms a signal in the time domain into the frequency domain.

It should be noted that the sound component extraction unit 104 divides the frequency signal into the magnitude and the phase of the frequency signal, and performs subtraction on the magnitudes of the above-described frequency signals for each frequency component in the above-described description. However, the sound component extraction unit 104 may, without dividing the frequency signal into the magnitude and the phase of the frequency signal, subtract the second frequency signal from the first frequency signal in a complex spectrum.

The sound component extraction unit 104 compares, to perform subtraction on the frequency signals in the complex spectrum, the first acoustic signal and the second acoustic signal, and subtracts the second frequency signal from the first frequency signal while taking into account the sign of the differential signal.

More specifically, for example, when the differential signal is generated by subtracting the second acoustic signal from the first acoustic signal (differential signal=first acoustic signal−second acoustic signal) and the magnitude of the first acoustic signal is greater than the magnitude of the second acoustic signal, the sound component extraction unit 104 subtracts the second frequency signal from the first frequency signal in the complex spectrum (first frequency signal−second frequency signal).

In a similar manner, when the magnitude of the second acoustic signal is greater than the magnitude of the first acoustic signal, the sound component extraction unit 104 subtracts the signal obtained by inverting the sign of the second frequency signal from the first frequency signal in the complex spectrum (first frequency signal−(−1)×second frequency signal).

With the above-described method or the like, it is possible to subtract the second frequency signal from the first frequency signal in the complex spectrum.

It should be noted that although the sound component extraction unit 104 performs subtraction while taking into account the sign of the differential signal determined by only the magnitudes of the first acoustic signal and the second acoustic signal in the above-described method, the sound component extraction unit 104 may further take into account the phases of the first acoustic signal and the second acoustic signal.

Furthermore, when the second frequency signal is subtracted from the first frequency signal, an operation method according to the magnitudes of the frequency signals may be used.

For example, when the "magnitude of first frequency signal−magnitude of second frequency signal≥0", the sound component extraction unit 104 subtracts the second frequency signal from the first frequency signal as they are.

On the other hand, when the "magnitude of first frequency signal−magnitude of second frequency signal<0", the sound component extraction unit 104 performs an operation of "first frequency signal−(magnitude of first frequency signal/magnitude of second frequency signal)×second frequency signal". With this, the second frequency signal having a reversed phase is not erroneously added to the first frequency signal.

In this manner, the second frequency signal is subtracted from the first frequency signal in a complex spectrum. This makes it possible for the sound component extraction unit 104 to generate the separated acoustic signal in which the phase of the frequency signal is more accurate.

When the extracted sound is individually reproduced, an effect of the phase of the frequency signal on a listener in terms of audibility is small, and thus an accurate operation need not necessarily be performed on the phase of the frequency signal. However, when a plurality of extracted sounds is reproduced simultaneously, attenuation of high frequency or the like occurs due to interference between phases of the extracted sounds, sometimes affecting the audibility.

Thus, for such a case, the above-described method in which the second frequency signal is subtracted from the first frequency signal in a complex spectrum is useful because interference between phases of the extracted sounds can be reduced.

(Specific Example of Operations Performed by the Sound Separation Device 100)

Figure 7:
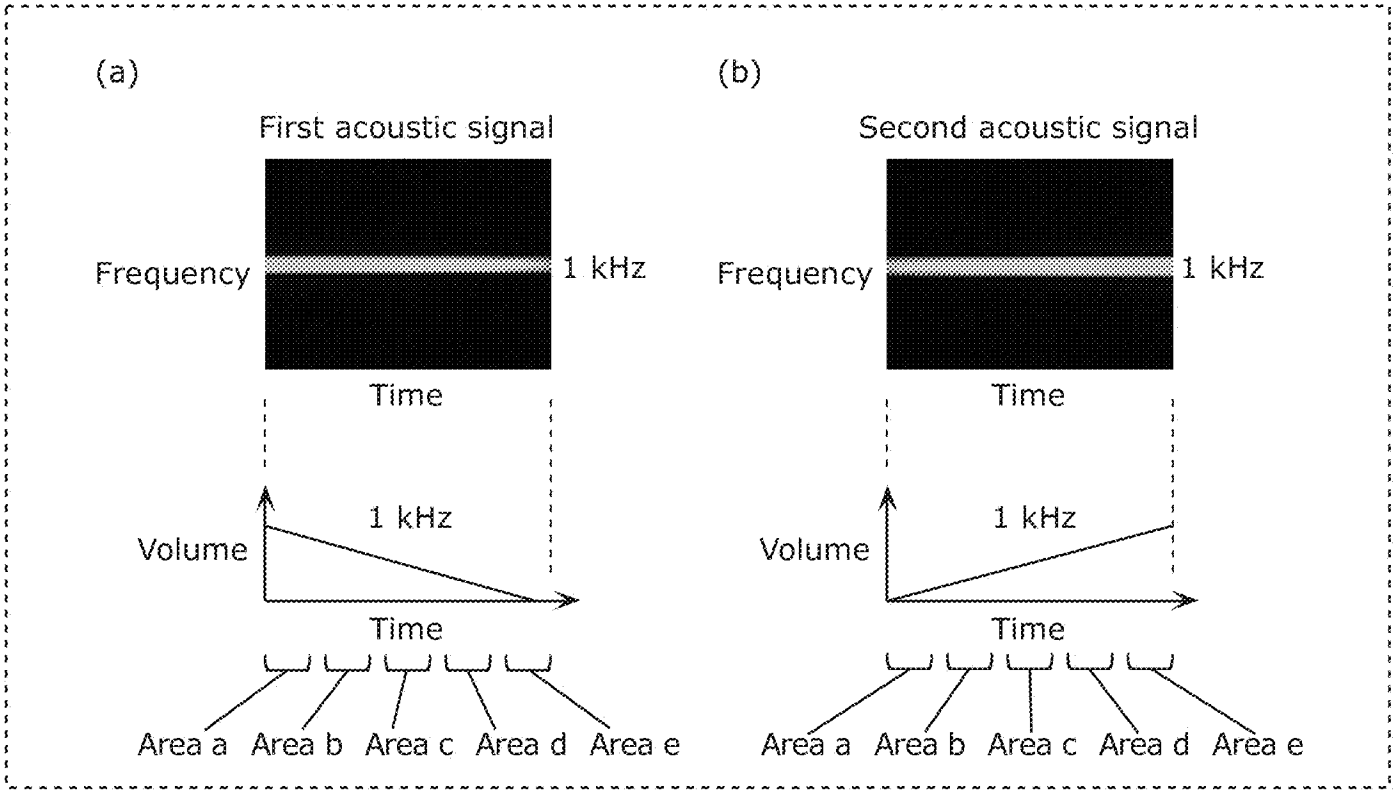
FIG. 7 shows diagrams showing specific examples of a first acoustic signal and a second acoustic signal.
Figure 8:
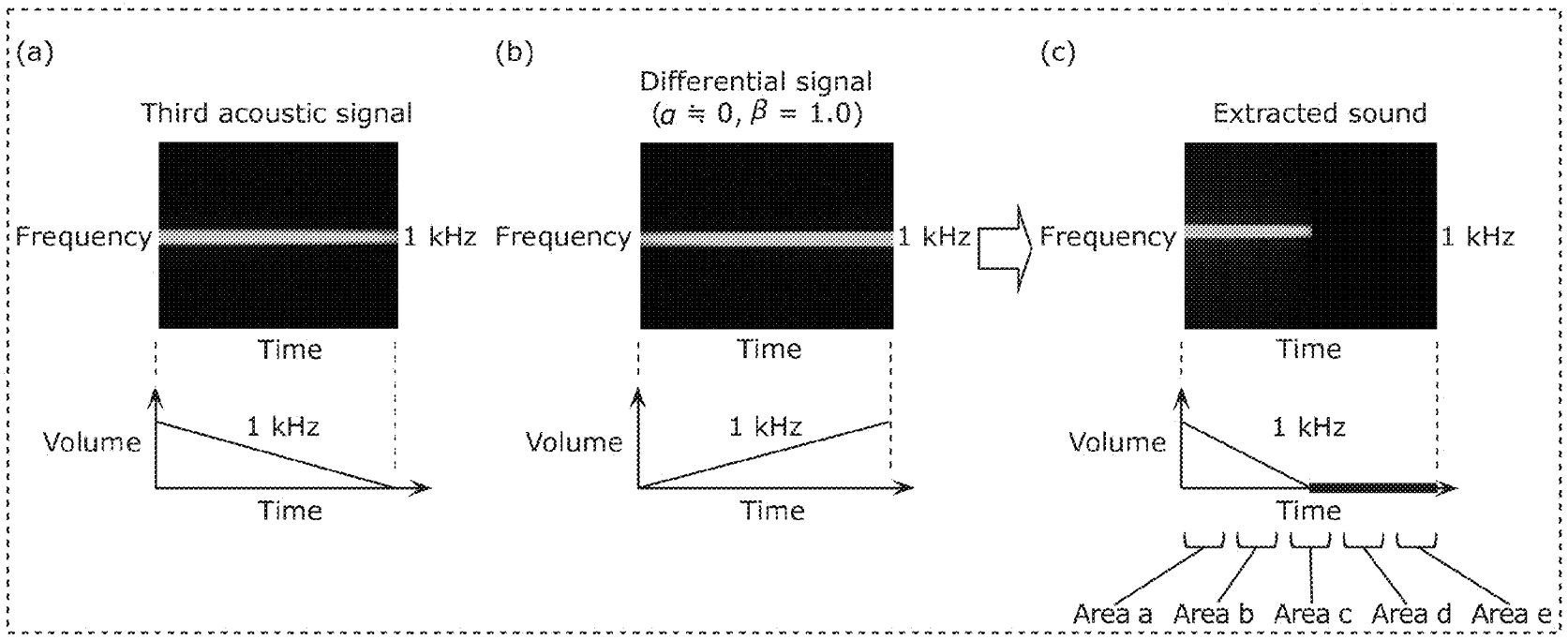
FIG. 8 shows diagrams showing a result of the case in which a sound component localized in an area a is extracted.
Figure 9:
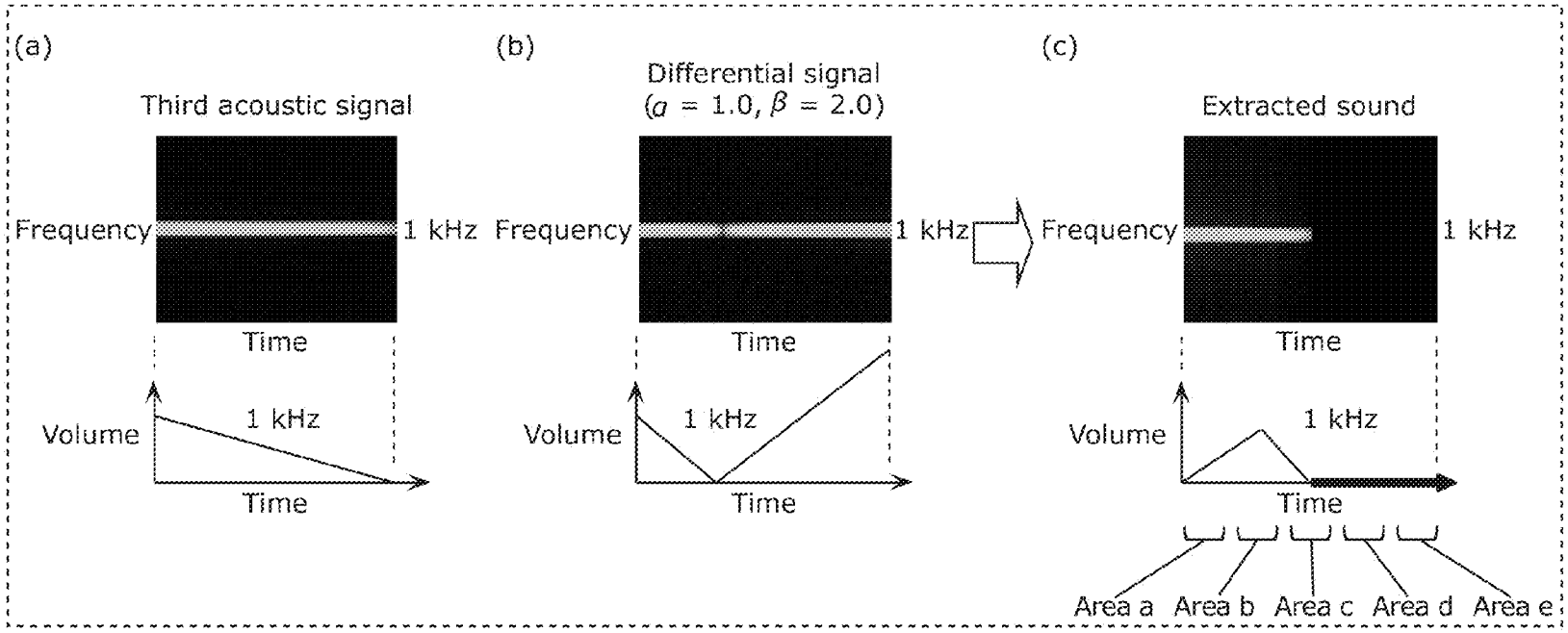
FIG. 9 shows diagrams showing a result of the case in which a sound component localized in an area b is extracted.

The following describes a specific example of operations performed by the sound separation device 100, using FIG. 7 to FIG. 9.

FIG. 7 shows diagrams showing specific examples of the first acoustic signal and the second acoustic signal.

Both the first acoustic signal shown in (a) in FIG. 7 and the second acoustic signal shown in (b) in FIG. 7 are sine waves of 1 kHz, and the phase of the first acoustic signal and the phase of the second acoustic signal are in phase with each other. Furthermore, the first acoustic signal represents a sound having a volume that decreases with time as shown in (a) in FIG. 7, and the second acoustic signal represents a sound having a volume that increases with time as shown in (b) in FIG. 7. Furthermore, it is assumed that the listener is positioned in front of the area c, and listens to a sound outputted from the first position using the first acoustic signal, and a sound outputted from the second position using the second acoustic signal.

The upper part of FIG. 7 shows relationships between a frequency of a sound (vertical axis) and a time (horizontal axis). In this drawing, brightness in color represents the volume of sound. The brighter color represents a greater value. In FIG. 7, sine waves of 1 kHz are used. Thus, in diagrams in the upper part of FIG. 7, the brightness in color is observed only in portions corresponding to 1 kHz, and other portions are black.

The lower part of FIG. 7 shows graphs which clarify the brightness in color in the diagrams on the upper part of FIG. 7 and represent relationships between the time (horizontal axis) and the volume (vertical axis) of the sound of the acoustic signal in a frequency band of 1 kHz.

An area a to an area e shown in FIG. 7 correspond to the area a to the area e in FIG. 5.

More specifically, in FIG. 7, in the time period described as the area a, the volume of the sound of the first acoustic signal is significantly greater than the volume of the sound of the second acoustic signal. Thus, in the time period described as the area a, the sound of 1 kHz is significantly biased on the first position-side and localized in the area a.

Furthermore, in FIG. 7, in the time period described as the area b, the volume of the sound of the first acoustic signal is greater than the volume of the sound of the second acoustic signal. Thus, in the time period described as the area b, the sound of 1 kHz is biased on the first position-side and localized in the area b.

Furthermore, in FIG. 7, in the time period described as the area c, the volume of the sound of the first acoustic signal is approximately the same as the volume of the sound of the second acoustic signal, and the sound of 1 kHz is localized in the area c.

Furthermore, in FIG. 7, in the time period described as the area d, the volume of the sound of the first acoustic signal is smaller than the volume of the sound of the second acoustic signal. Thus, in the time period described as the area d, the sound of 1 kHz is biased on the second position-side and localized in the area d.

Furthermore, in FIG. 7, in the time period described as the area e, the volume of the sound of the first acoustic signal is significantly smaller than the volume of the sound of the second acoustic signal. Thus, in the time period described as the area e, the sound of 1 kHz is significantly biased on the second position-side and localized in the area e.

FIG. 8 to FIG. 12 are diagrams showing the results of the case where the sound separation device 100 is operated using the acoustic signals shown in FIG. 7. Note that, the indication method of diagrams shown in FIG. 8 to FIG. 12 is similar to the indication method in FIG. 7. Thus, the description thereof is omitted here.

In FIG. 8, (a) shows a sound of the third acoustic signal, (b) shows a sound of the differential signal, and (c) shows an extracted sound, in the case where the sound separation device 100 extracts the sound component localized in the area a.

When the sound component localized in the area a is extracted, the acoustic signal generation unit 102 uses, as the third acoustic signal, the first acoustic signal as it is. The third acoustic signal in this case is expressed as shown in (a) in FIG. 8.

Furthermore, when the sound component localized in the area a is extracted, the differential signal generation unit 103 determines the values of the coefficients so that the second weighting coefficient $\beta$ is significantly greater than the first weighting coefficient $\alpha$, and generates the differential signal by subtracting, from the signal obtained by multiplying the first acoustic signal by the first weighting coefficient $\alpha$, the signal obtained by multiplying the second acoustic signal by the second weighting coefficient $\beta$. More specifically, the first weighting coefficient $\alpha$ is a value significantly smaller than 1.0 (approximately zero), and the second weighting coefficient $\beta$ is 1.0. The differential signal in this case is expressed as shown in (b) in FIG. 8.

The sound of the separated acoustic signal generated by the sound component extraction unit 104 from the above-described third acoustic signal and the differential signal is the extracted sound shown in (c) in FIG. 8. The volume of the extracted sound shown in (c) in FIG. 8 is greatest in the time period described as the area a. More specifically, the sound separation device 100 successfully extracts, as the extracted sound, the sound component localized in the area a. It should be noted that, as described above, in the case where the magnitude of the frequency signal obtained by the sound component extraction unit 104 by the subtraction operation is a negative value, the magnitude of the frequency signal obtained by the subtraction operation is handled as approximately zero.

In FIG. 9, (a) shows a sound of the third acoustic signal, (b) shows a sound of the differential signal, and (c) shows an extracted sound, in the case where the sound separation device 100 extracts the sound component localized in the area b.

When the sound component localized in the area b is extracted, the acoustic signal generation unit 102 uses, as the third acoustic signal, the first acoustic signal as it is. The third acoustic signal in this case is expressed as shown in (a) in FIG. 9.

Furthermore, when the sound component localized in the area b is extracted, the differential signal generation unit 103 determines the values of the coefficients so that the second weighting coefficient $\beta$ is greater than the first weighting coefficient $\alpha$, and generates the differential signal by subtracting, from the signal obtained by multiplying the first acoustic signal by the first weighting coefficient $\alpha$, the signal obtained by multiplying the second acoustic signal by the second weighting coefficient $\beta$. More specifically, the first weighting coefficient $\alpha$ is 1.0, and the second weighting coefficient $\beta$ is 2.0. The differential signal in this case is expressed as shown in (b) in FIG. 9.

The sound of the separated acoustic signal generated by the sound component extraction unit 104 from the above-described third acoustic signal and the differential signal is the extracted sound shown in (c) in FIG. 9. The volume of the extracted sound shown in (c) in FIG. 9 is greatest in the time period described as the area b. More specifically, the sound separation device 100 successfully extracts, as the extracted sound, the sound component localized in the area b. It should be noted that, as described above, in the case where the magnitude of the frequency signal obtained by the sound component extraction unit 104 by the subtraction operation is a negative value, the magnitude of the frequency signal obtained by the subtraction operation is handled as approximately zero.

Figure 10:
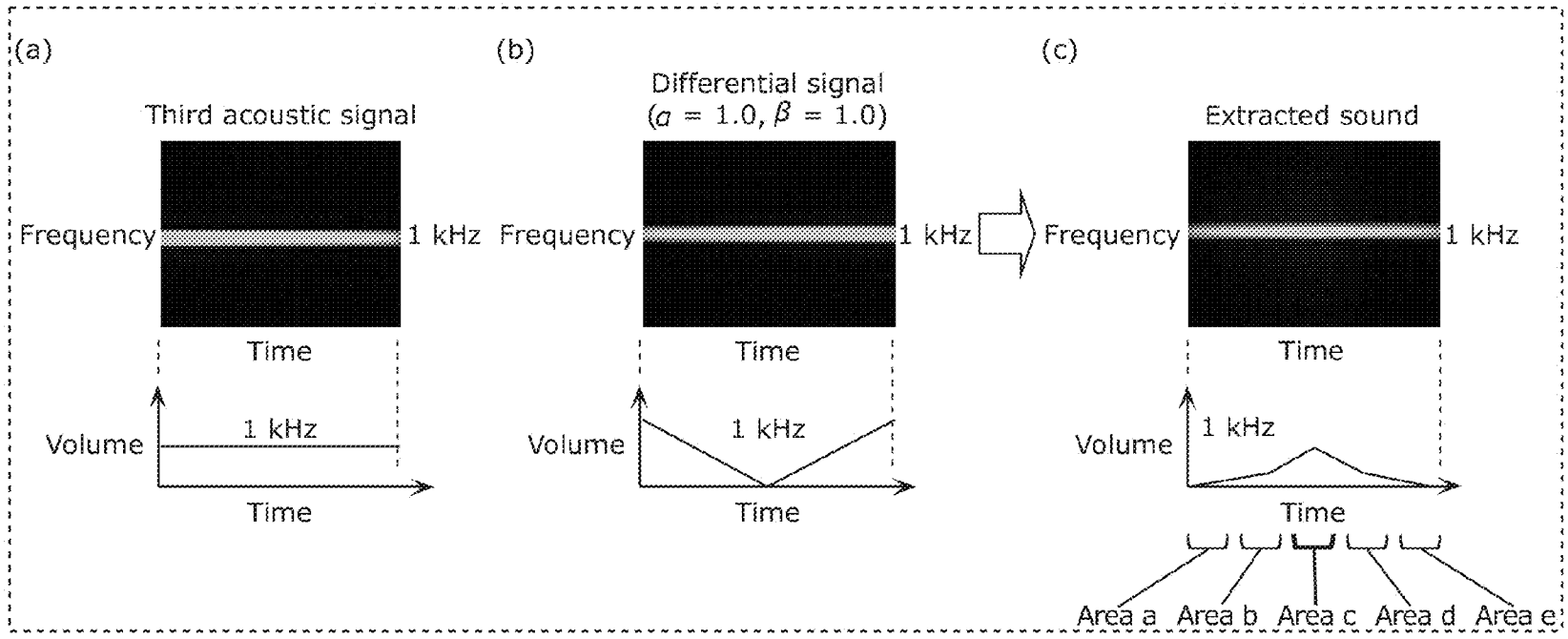
FIG. 10 shows diagrams showing a result of the case in which a sound component localized in an area c is extracted.

In FIG. 10, (a) shows a sound of the third acoustic signal, (b) shows a sound of the differential signal, and (c) shows an extracted sound used in this experiment, in the case where the sound separation device 100 extracts the sound component localized in the area c.

When the sound component localized in the area c is extracted, the acoustic signal generation unit 102 uses, as the third acoustic signal, the sum of the first acoustic signal and the second acoustic signal. The third acoustic signal in this case is expressed as shown in (a) in FIG. 10.

Furthermore, when the sound component localized in the area c is extracted, the differential signal generation unit 103 determines the values of the coefficients so that the first weighting coefficient $\alpha$ equals to the second weighting coefficient $\beta$, and generates the differential signal by subtracting, from the signal obtained by multiplying the first acoustic signal by the first weighting coefficient $\alpha$, the signal obtained by multiplying the second acoustic signal by the second weighting coefficient $\beta$. More specifically, the first weighting coefficient $\alpha$ is 1.0, and the second weighting coefficient $\beta$ is 1.0. The differential signal in this case is expressed as shown in (b) in FIG. 10.

The sound of the separated acoustic signal generated by the sound component extraction unit 104 from the above-described third acoustic signal and the differential signal is the extracted sound shown in (c) in FIG. 10. The volume of the extracted sound shown in (c) in FIG. 10 is greatest in the time period described as the area c. More specifically, the sound separation device 100 successfully extracts, as the extracted sound, the sound component localized in the area c. It should be noted that, as described above, in the case where the magnitude of the frequency signal obtained by the sound component extraction unit 104 by the subtraction operation is a negative value, the magnitude of the frequency signal obtained by the subtraction operation is handled as approximately zero.

Figure 11:
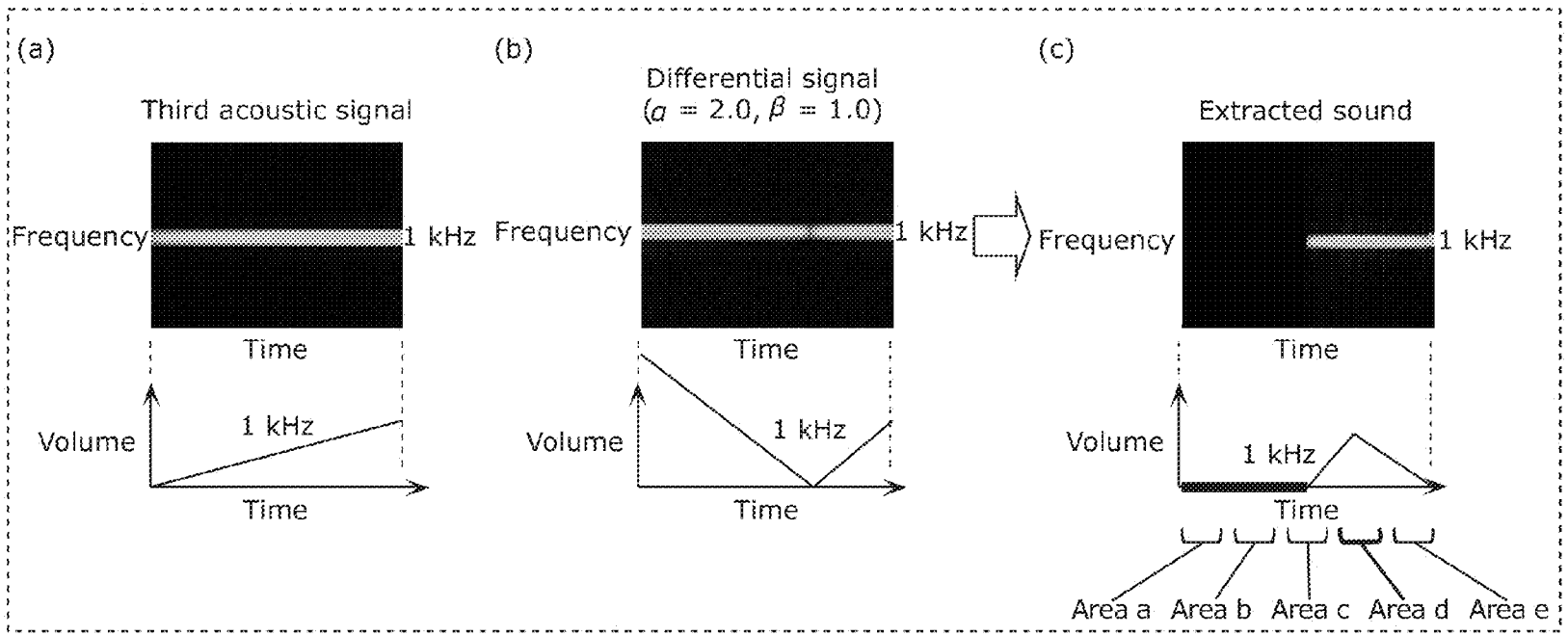
FIG. 11 shows diagrams showing a result of the case in which a sound component localized in an area d is extracted.

In FIG. 11, (a) shows a sound of the third acoustic signal, (b) shows a sound of the differential signal, and (c) shows an extracted sound used in this experiment, in the case where the sound separation device 100 extracts the sound component localized in the area d.

When the sound component localized in the area d is extracted, the acoustic signal generation unit 102 uses, as the third acoustic signal, the second acoustic signal as it is. The third acoustic signal in this case is expressed as shown in (a) in FIG. 11.

Furthermore, when the sound component localized in the area d is extracted, the differential signal generation unit 103 determines the values of the coefficients so that the second weighting coefficient $\beta$ is smaller than the first weighting coefficient $\alpha$, and generates the differential signal by subtracting, from the signal obtained by multiplying the first acoustic signal by the first weighting coefficient $\alpha$, the signal obtained by multiplying the second acoustic signal by the second weighting coefficient $\beta$. More specifically, the first weighting coefficient $\alpha$ is 2.0, and the second weighting coefficient $\beta$ is 1.0. The differential signal in this case is expressed as shown in (b) in FIG. 11.

The sound of the separated acoustic signal generated by the sound component extraction unit 104 from the above-described third acoustic signal and the differential signal is the extracted sound shown in (c) in FIG. 11. The volume of the extracted sound shown in (c) in FIG. 11 is greatest in the time period described as the area d. More specifically, the sound separation device 100 successfully extracts, as the extracted sound, the sound component localized in the area d. It should be noted that, as described above, in the case where the magnitude of the frequency signal obtained by the sound component extraction unit 104 by the subtraction operation is a negative value, the magnitude of the frequency signal obtained by the subtraction operation is handled as approximately zero.

Figure 12:
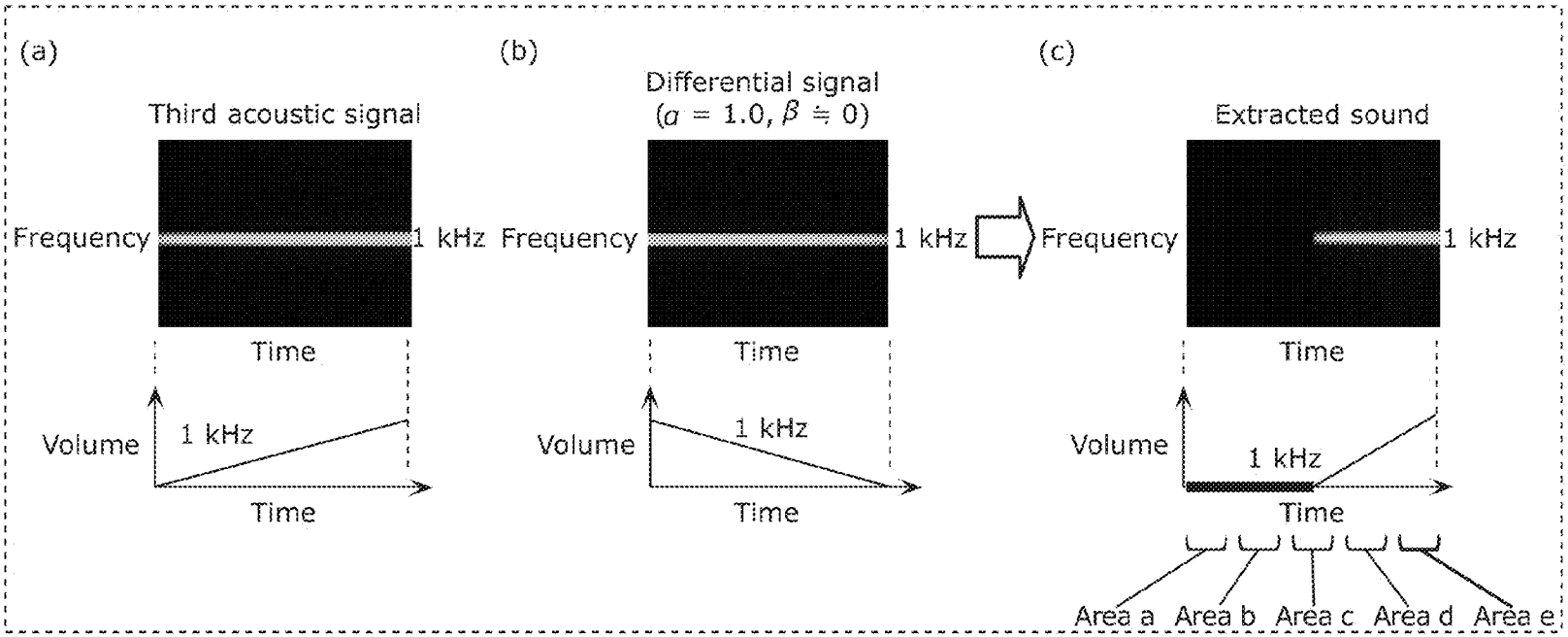
FIG. 12 shows diagrams showing a result of the case in which a sound component localized in an area e is extracted.

In FIG. 12, (a) shows a sound of the third acoustic signal, (b) shows a sound of the differential signal, and (c) shows an extracted sound used in this experiment, in the case where the sound separation device 100 extracts the sound component localized in the area e.

When the sound component localized in the area e is extracted, the acoustic signal generation unit 102 uses, as the third acoustic signal, the second acoustic signal as it is. The third acoustic signal in this case is expressed as shown in (a) in FIG. 12.

Furthermore, when the sound component localized in the area e is extracted, the differential signal generation unit 103 determines the values of the coefficients so that the second weighting coefficient $\beta$ is significantly smaller than the first weighting coefficient $\alpha$, and generates the differential signal by subtracting, from the signal obtained by multiplying the first acoustic signal by the first weighting coefficient $\alpha$, the signal obtained by multiplying the second acoustic signal by the second weighting coefficient $\beta$. More specifically, the first weighting coefficient $\alpha$ is 1.0, and the second weighting coefficient $\beta$ is a value (approximately zero) significantly smaller than 1.0. The differential signal in this case is expressed as shown in (b) in FIG. 12.

The sound of the separated acoustic signal generated by the sound component extraction unit 104 from the above-described third acoustic signal and the differential signal is the extracted sound shown in (c) in FIG. 12. The volume of the extracted sound shown in (c) in FIG. 12 is greatest in the time period described as the area e. More specifically, the sound separation device 100 successfully extracts, as the extracted sound, the sound component localized in the area e. It should be noted that, as described above, in the case where the magnitude of the frequency signal obtained by the sound component extraction unit 104 by the subtraction operation is a negative value, the magnitude of the frequency signal obtained by the subtraction operation is handled as approximately zero.

The following describes a more specific example of the operations performed by the sound separation device 100, using FIG. 13 to FIG. 16.

Figure 13:
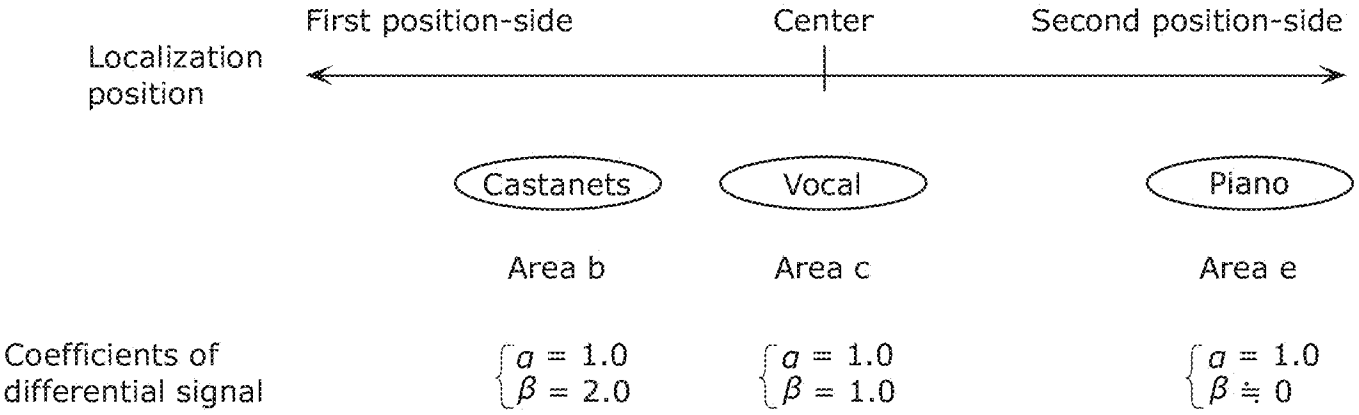
FIG. 13 is a conceptual diagram showing a specific example of localization positions of extraction-target sounds.

FIG. 13 is a conceptual diagram showing a specific example of localization positions of extraction-target sounds.

Each of FIG. 14 to FIG. 16 in the following description shows the sound of the third acoustic signal, the sound of the differential signal, and the extracted sound in the case where the sound of castanets is localized in the area b, the sound of a vocal is localized in the area c, and the sound of a piano is localized in the area e as shown in FIG. 13, and the sounds localized in the respective regions are extracted. It should be noted that FIG. 14 to FIG. 16 respectively show a relationship between the frequency (vertical axis) and the time (horizontal axis) of one of the above-described three sounds.

In the drawing, brightness in color represents the volume of the sound. The brighter color represents a greater value.

Figure 14:
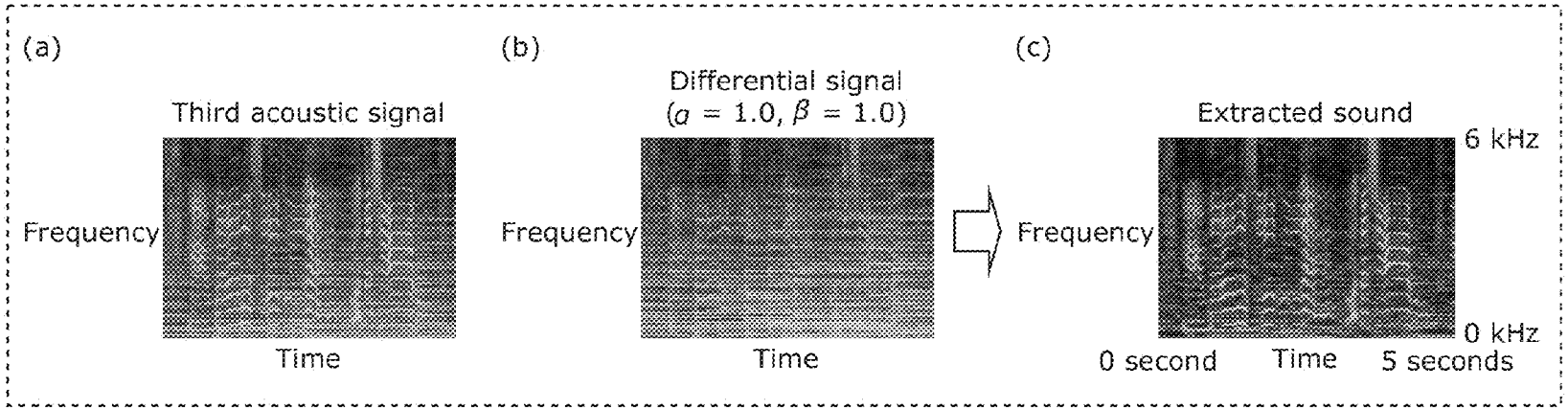
FIG. 14 shows diagrams showing a result of the case in which a sound component of a vocal localized in the area c is extracted.

In FIG. 14, (a) shows a sound of the third acoustic signal, (b) shows a sound of the differential signal, and (c) shows an extracted sound, in the case where the sound component of the vocal localized in the area c is extracted.

When the sound component of the vocal localized in the area c is extracted, the acoustic signal generation unit 102 uses, as the third acoustic signal, the sum of the first acoustic signal and the second acoustic signal which include a sound component localized in the area c. The third acoustic signal in this case is expressed as shown in (a) in FIG. 14.

Furthermore, in this case, the differential signal generation unit 103 determines the values of the coefficients so that the first weighting coefficient $\alpha$ equals to the second weighting coefficient $\beta$, and generates the differential signal. More specifically, the first weighting coefficient $\alpha$ is 1.0, and the second weighting coefficient $\beta$ is 1.0. The differential signal in this case is expressed as shown in (b) in FIG. 14.

(c) in FIG. 14 shows the extracted sound which is the sound obtained by extracting the sound component of the vocal localized in the area c. Comparison between the third acoustic signal shown in (a) in FIG. 14 and the extracted sound shows that the S/N ratio of the sound component of the vocal is improved.

Figure 15:
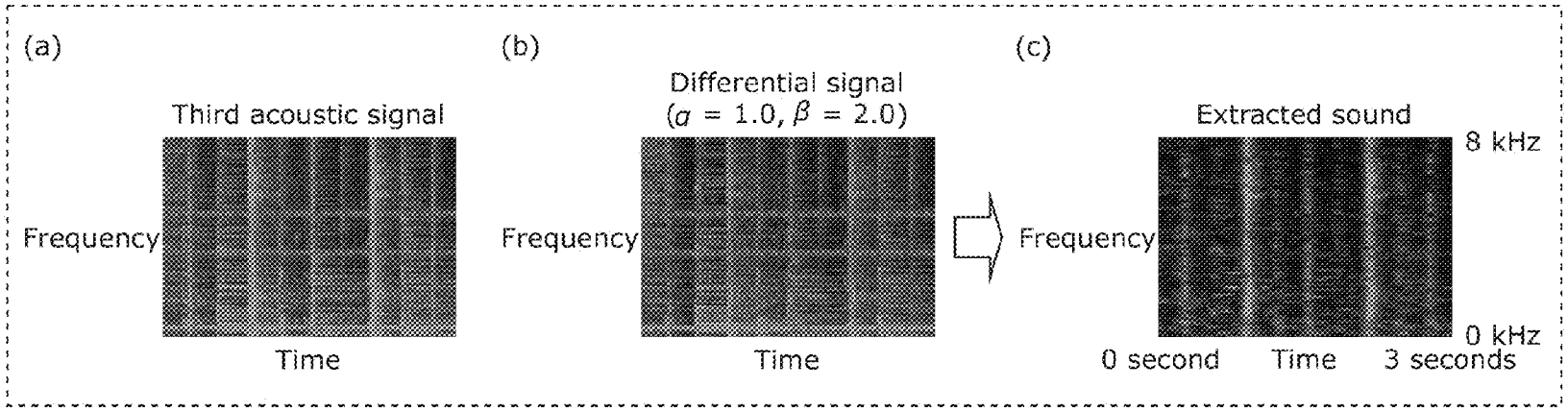
FIG. 15 shows diagrams showing a result of the case in which a sound component of castanets localized in the area b is extracted.

FIG. 15 shows the third acoustic signal, the differential signal, and an extracted sound (c) in the case where the sound component of the castanets localized in the area b is extracted.

When the sound component of the castanets localized in the area b is extracted, the acoustic signal generation unit 102 uses, as the third acoustic signal, the first acoustic signal, which includes the sound component localized in the area b, as it is. The third acoustic signal in this case is expressed as shown in (a) in FIG. 15.

Furthermore, in this case, the differential signal generation unit 103 determines the values of the coefficients so that the second weighting coefficient $\beta$ is greater than the first weighting coefficient $\alpha$, and generates the differential signal. More specifically, the first weighting coefficient $\alpha$ is 1.0, and the second weighting coefficient $\ominus$ is 2.0. The differential signal in this case is expressed as shown in (b) in FIG. 15.

(c) in FIG. 15 shows the extracted sound which is the sound obtained by extracting the sound component of the castanets localized in the area b. Comparison between the third acoustic signal shown in (a) in FIG. 15 and the extracted sound shows that the S/N ratio of the sound component of the castanets is improved.

Figure 16:
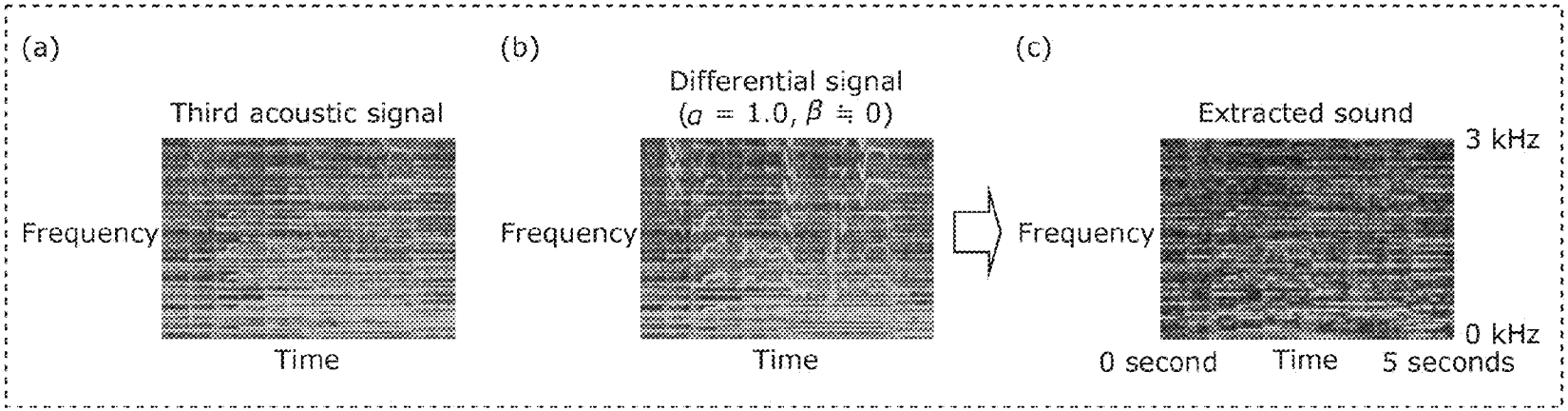
FIG. 16 shows diagrams showing a result of the case in which a sound component of a piano localized in the area e is extracted.

In FIG. 16, (a) shows a sound of the third acoustic signal, (b) shows a sound of the differential signal, and (c) shows an extracted sound, in the case where the sound component of the piano localized in the area e is extracted.

When the sound component of the piano localized in the area e is extracted, the acoustic signal generation unit 102 uses, as the third acoustic signal, the second acoustic signal, which includes the sound component localized in the area e, as it is. The third acoustic signal in this case is expressed as shown in (a) in FIG. 16.

Furthermore, in this case, the differential signal generation unit 103 determines the values of the coefficients so that the second weighting coefficient $\beta$ is significantly smaller than the first weighting coefficient $\alpha$, and generates the differential signal. More specifically, the first weighting coefficient $\alpha$ is 1.0, and the second weighting coefficient $\beta$ is a value (approximately zero) significantly smaller than 1.0.

(c) in FIG. 16 shows the extracted sound which is the sound obtained by extracting the sound component of the piano localized in the area e. Comparison between the third acoustic signal shown in (a) in FIG. 16 and the extracted sound shows that the S/N ratio of the sound component of the piano is improved.

(Other Examples of the First Acoustic Signal and the Second Acoustic Signal)

As described above, typically, the first acoustic signal and the second acoustic signal are the L signal and the R signal which form the stereo signal.

Figure 17:
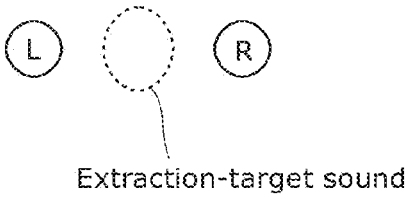
FIG. 17 is a schematic diagram showing the case in which the first acoustic signal is an L signal of a stereo signal, and the second acoustic signal is an R signal of the stereo signal.

FIG. 17 is a schematic diagram showing the case in which the first acoustic signal is an L signal of a stereo signal, and the second acoustic signal is an R signal of the stereo signal.

In the example shown in FIG. 17, the sound separation device 100 extracts an extraction-target sound localized between the position in which the sound of the L signal is outputted (position where the L channel speaker is disposed) and the position in which the sound of the R signal is outputted (position where the R channel speaker is disposed) by the above-described stereo signal. More specifically, the signal obtainment unit 101 obtains the L signal and the R signal that are the above-described stereo signal, and the acoustic signal generation unit 102 generates, as the third acoustic signal, an acoustic signal ($\gamma L+\eta R$) by adding a signal obtained by multiplying the L signal by a first coefficient $\gamma$ and a signal obtained by multiplying the R signal by a second coefficient $\eta$ (each of $\gamma$ and $\eta$ is a real number greater than or equal to zero).

However, the first acoustic signal and the second acoustic signal are not limited to the L signal and the R signal which form the stereo signal. For example, the first acoustic signal and the second acoustic signal may be arbitrary two acoustic signals which are selected from the 5.1 channel (hereinafter described as 5.1 ch) acoustic signals and are different from each other.

Figure 18:
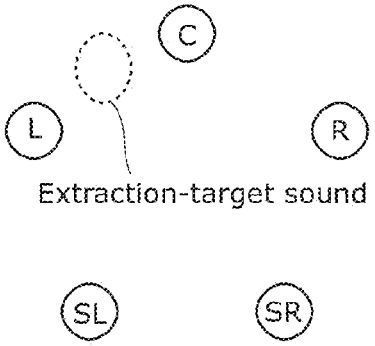
FIG. 18 is a schematic diagram showing the case in which the first acoustic signal is an L signal of 5.1 channel acoustic signals, and the second acoustic signal is a C signal of the 5.1 channel acoustic signals.

FIG. 18 is a schematic diagram showing the case in which the first acoustic signal is an L signal (front left signal) of a 5.1 ch acoustic signals, and the second acoustic signal is a C signal of the 5.1 ch acoustic signals (front center signal).

In the example shown in FIG. 18, the acoustic signal generation unit 102 generates, as the third acoustic signal, an acoustic signal ($\gamma L+\eta C$) by adding a signal obtained by multiplying the L signal by the first coefficient $\gamma$ and a signal obtained by multiplying the C signal by the second coefficient $\eta$ (each of $\gamma$ and $\eta$ is a real number greater than or equal to zero). Then, the sound separation device 100 extracts the extraction-target sound component localized between the position where the sound of the L signal is outputted and the position where the sound of the C signal is outputted by the L signal and the C signal of the 5.1 ch acoustic signals.

Figure 19:
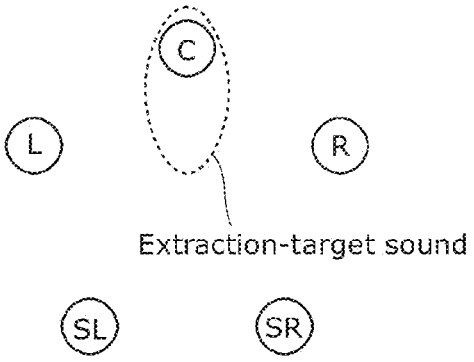
FIG. 19 is a schematic diagram showing the case in which the first acoustic signal is the L signal of the 5.1 channel acoustic signals, and the second acoustic signal is an R signal of the 5.1 channel acoustic signals.

Furthermore, FIG. 19 is a schematic diagram showing the case in which the first acoustic signal is the L signal of the 5.1 ch acoustic signals, and the second acoustic signal is the R signal (front right signal) of the 5.1 ch acoustic signals.

In the example shown in FIG. 19, the sound separation device 100 extracts an extraction-target sound component localized between the position in which the sound of the L signal is outputted and the position in which the sound of the R signal is outputted by the L signal, the C signal, and the R signal of the 5.1 ch acoustic signals. More specifically, the signal obtainment unit 101 obtains at least the L signal, C signal, and the R signal which are included in the 5.1 ch acoustic signals.

In the example shown in FIG. 19, the acoustic signal generation unit 102 generates an acoustic signal ($\gamma L+\eta R+\zeta C$) by adding a signal obtained by multiplying the L signal by the first coefficient γ, the signal obtained by multiplying the R signal by the second coefficient η, and the signal obtained by multiplying the C signal by the third coefficient ζ (each of Γ, η, and ζ is a real number greater than or equal to zero).

For example, when γ=Θ=0, the third acoustic signal is the C signal itself. Furthermore, for example, when γ=η=ζ=1, the third acoustic signal is a signal obtained by adding the L signal, the R signal, and the C signal.

(Summary)

As described above, the sound separation device 100 according to Embodiment 1 can accurately generate the acoustic signal (separated acoustic signal) of the extraction-target sound localized in a predetermined position by the first acoustic signal and the second acoustic signal. More specifically, the sound separation device 100 can extract the extraction-target sound according to the localization position of the sound.

When the sound source of each sound (separated acoustic signal) extracted by the sound separation device 100 is reproduced through a corresponding speaker or the like arranged in a corresponding position or a direction, a user (listener) can enjoy a three-dimensional acoustic space.

For example, the user can extract, using the sound separation device 100, vocal audio or a musical instrument sound which is recorded in a studio by on-mike or the like from a package media, downloaded music content, or the like, and enjoy listening to only the extracted vocal audio or the musical instrument sound.

In a similar manner, the user can extract, using the sound separation device 100, audio such as a line or the like from a package media, broadcasted movie content, or the like. The user can clearly listen to audio, such as a line, by reproduction while emphasizing on audio such as the extracted line or the like.

Furthermore, for example, the user can extract an extraction-target sound from news audio by using the sound separation device 100. In this case, for example, the user can listen to news audio in which the extraction-target sound is clearer by reproducing the acoustic signal of the extracted sound through a speaker close to an ear of the user.

Furthermore, for example, using the sound separation device 100, the user can edit a sound recorded by a digital still camera or a digital video camera, by extracting the recorded sound for respective localization positions. This enables listening by the user, emphasizing on a sound component of interest.

Furthermore, for example, using the sound separation device 100, the user can extract, for a sound source which is recorded with 5.1 channels, 7.1 channels, 22.2 channels, or the like, a sound component localized in an arbitrary position between channels, and generate the corresponding acoustic signal. Thus, the user can generate the acoustic signal component suitable for the position of the speaker.

Embodiment 2

Embodiment 2 describes a sound separation device which further includes a sound modification unit. There is a case in which the sound extracted by a sound separation device 100 has a narrow localization range and a space where no sound is localized is created in a listening space of a listener, when the separated acoustic signals having narrow localization ranges are reproduced. The sound modification unit is characterized by spatially smoothly connecting the extracted sounds so as to avoid creation of the space where no sound is localized.

Figure 20:
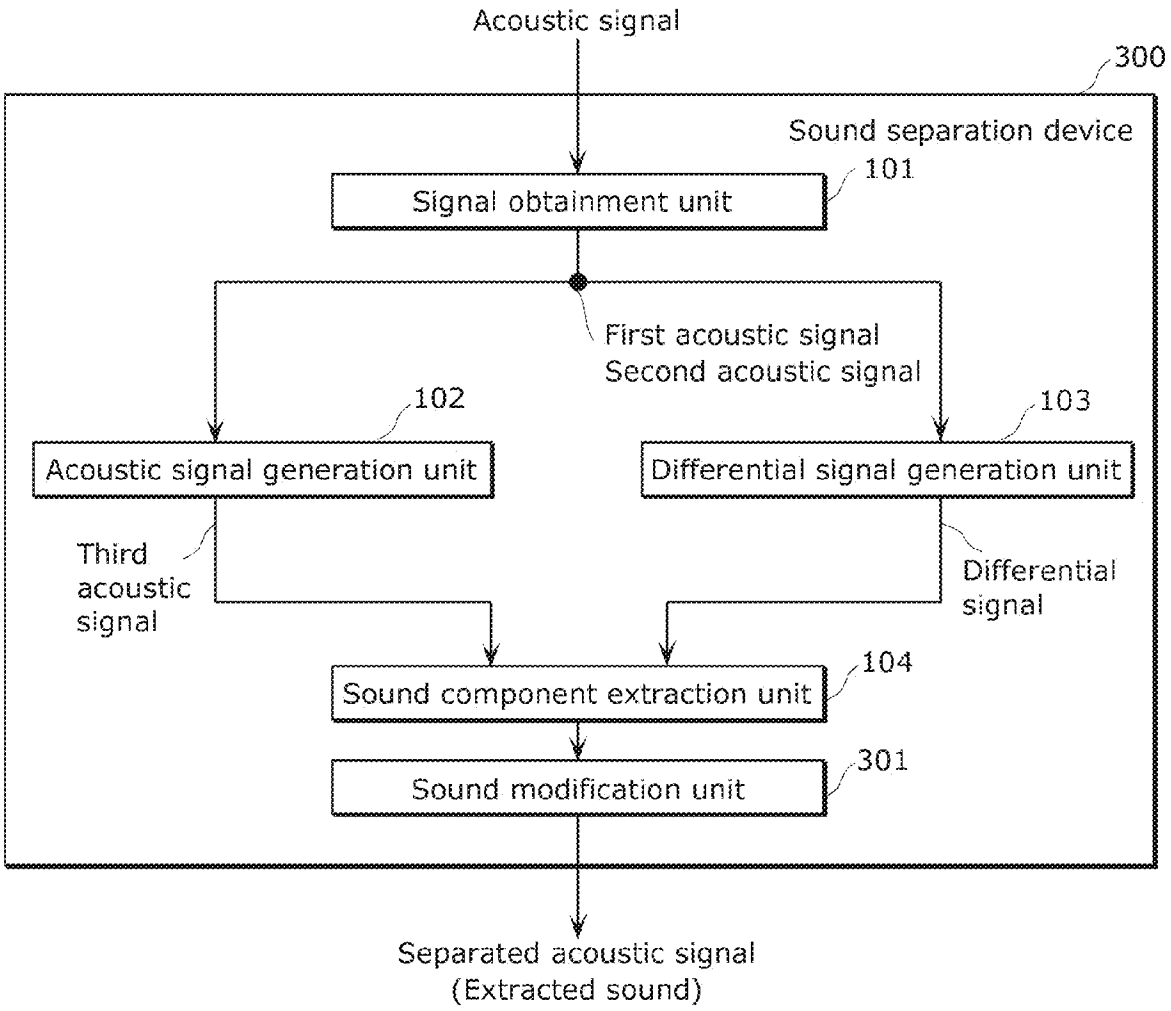
FIG. 20 is a functional block diagram showing a configuration of a sound separation device according to Embodiment 2.

FIG. 20 is a functional block diagram showing a configuration of a sound separation device 300 according to Embodiment 2.

The sound separation device 300 includes: a signal obtainment unit 101; an acoustic signal generation unit 102; a differential signal generation unit 103; a sound component extraction unit 104; and a sound modification unit 301. Different from the sound separation device 100, the sound separation device 300 includes the sound modification unit 301. It should be noted that other structural elements are assumed to have similar functions and operate in a similar manner as in Embodiment 1, and descriptions thereof are omitted.

The sound modification unit 301 adds, to the separated acoustic signal generated by the sound component extraction unit 104, the sound component localized around the localization position.

Next, operations performed by the sound separation device 300 are described.

Figure 21:
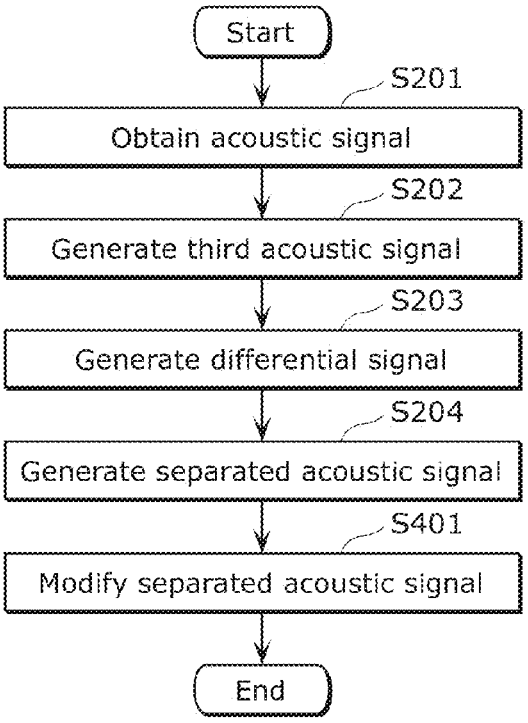
FIG. 21 is a flowchart showing operations performed by the sound separation device according to Embodiment 2.
Figure 22:
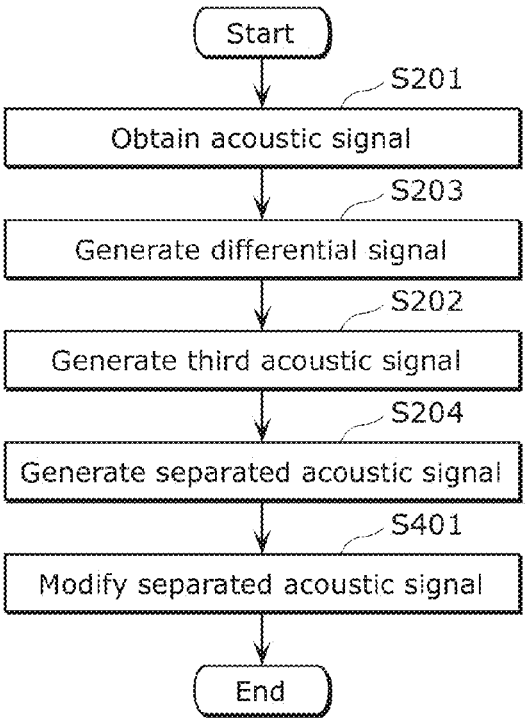
FIG. 22 is another flowchart showing operations performed by the sound separation device according to Embodiment 2.

Each of FIG. 21 and FIG. 22 is a flowchart showing operations performed by the sound separation device 300.

The flowchart shown in FIG. 21 is a flowchart in which step S401 is added to the flowchart shown in FIG. 3. The flowchart shown in FIG. 22 is a flowchart in which step S401 is added to the flowchart shown in FIG. 4.

The following describes the operation in step S401, that is, details of operations performed by the sound modification unit 301 with reference to drawings.

(Regarding Operations Performed by Sound Modification Unit)

Figure 23:
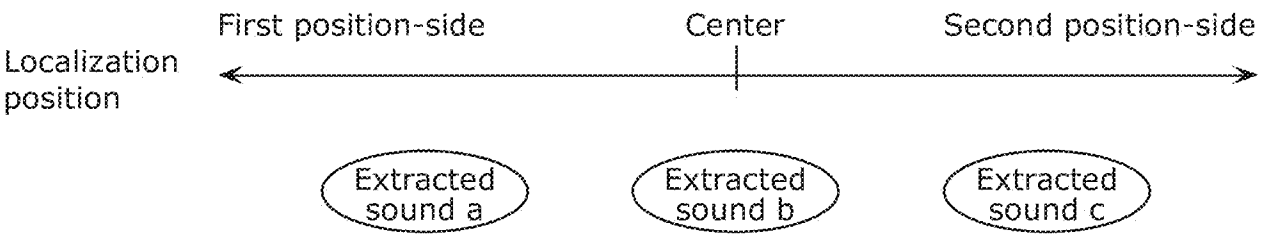
FIG. 23 is a conceptual diagram showing localization positions of extracted sounds.

FIG. 23 is a conceptual diagram showing the localization positions of the extracted sounds. In the following description, as shown in FIG. 23, it is assumed that an extracted sound a is a sound localized on a first acoustic signal-side, an extracted sound b is a sound localized in the center between the first acoustic signal-side and the second acoustic signal-side, and the extracted sound c is a sound localized on a second acoustic signal-side.

Figure 24:
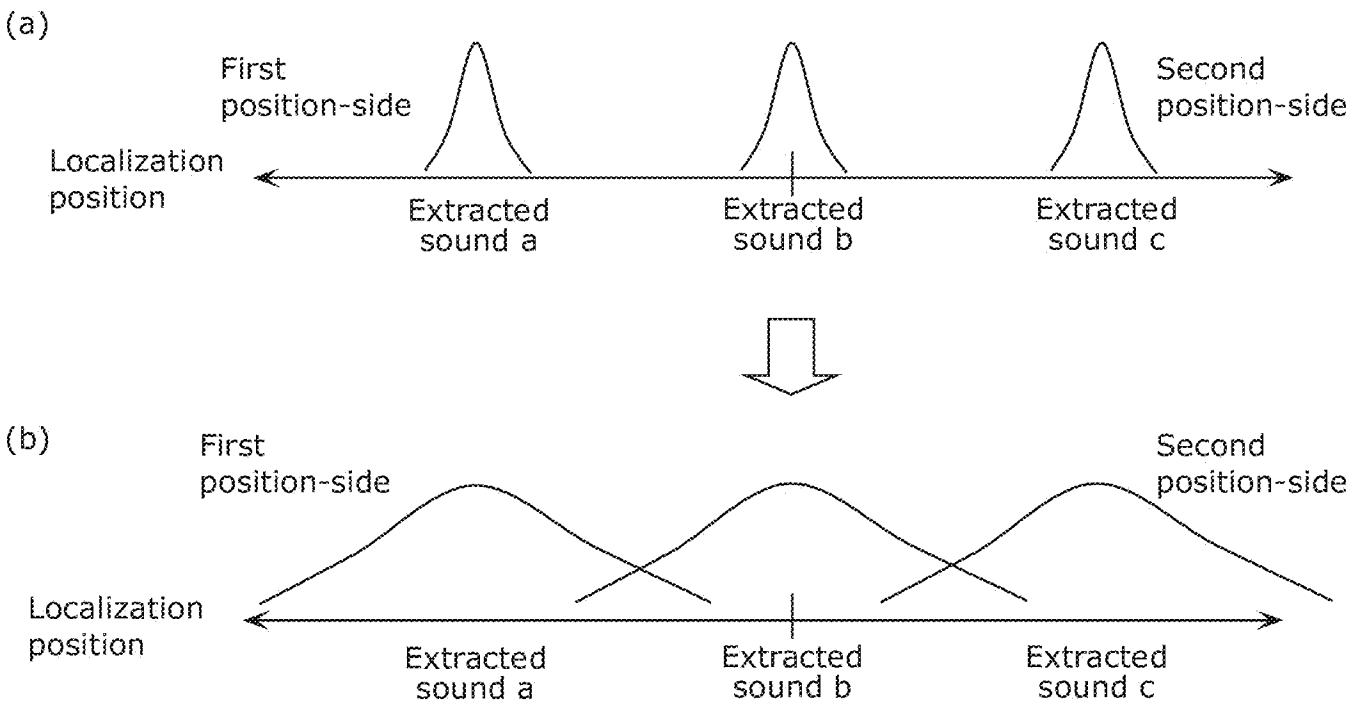
FIG. 24 shows diagrams each schematically showing localization ranges of the extracted sounds.

FIG. 24 is a diagram schematically showing a localization range of the extracted sound (sound pressure distribution).

In FIG. 24, the top-bottom direction (vertical axis) of the diagram indicates the magnitude of the sound pressure of the extracted sound, and the left-right direction (horizontal axis) of the diagram indicates a localization position and a localization range.

As shown in (a) in FIG. 24, when the extracted sound a, the extracted sound b, and the extracted sound c are outputted from respective positions, an area where no sound is localized exists between the area where the extracted sound a is localized and the area where the extracted sound b is localized. Furthermore, in a similar manner, an area where no sound is localized exists between the area where the extracted sound b is localized and the area where the extracted sound c is localized. In this manner, there is a case where an area (space) where no sound is localized is created between the extracted sounds.

In view of this, as shown in (b) in FIG. 24, the sound modification unit 301 respectively adds, to the extracted sounds a to c, sound components (modification acoustic signals) which are localized around the localization positions corresponding to the localization positions of the extracted sounds a to c.

In Embodiment 2, the sound modification unit 301 generates the sound component localized around the localization position of the extracted sound, by performing weighted addition on the first acoustic signal and the second acoustic signal determined according to the localization position of the extracted sound.

More specifically, first, the sound modification unit 301 determines a third coefficient which is a value that increases with a decrease in a distance from the localization position of the extracted sound to the first position, and a fourth coefficient which is a value that increases with a decrease in a distance from the localization position of the extracted sound to the second position. Then, the sound modification unit 301 adds, to the separated acoustic signal which represents the extracted sound, a signal obtained by multiplying the first acoustic signal by the third coefficient and a signal obtained by multiplying the second acoustic signal by the fourth coefficient.

It should be noted that the modification acoustic signal may be generated according to the localization position of the extracted sound by using at least one acoustic signal among the acoustic signals obtained by the signal obtainment unit 101. For example, the modification acoustic signal may be generated by performing a weighted addition on the acoustic signals obtained by the signal obtainment unit 101, by applying a panning technique.

For example, in the case shown in FIG. 19, the modification acoustic signal of the extracted sound localized in the center of positions, which are the position of an L signal, the position of a C signal, and the position of an R signal, may be generated by performing a weighted addition on the L signal, the C signal, the R signal, an SL signal, and an SR signal.

Furthermore, for example, in the case shown in FIG. 19, the modification acoustic signal of the extracted sound localized in the center of positions, which are the position of the L signal, the position of the C signal, and the position of the R signal, may be generated from the C signal.

Furthermore, for example, in the case shown in FIG. 19, the modification acoustic signal of the extracted sound localized in the center of positions, which are the position of the L signal, the position of the C signal, and the position of the R signal, may be generated by performing weighted addition on the L signal, and the R signal.

Furthermore, for example, in the case shown in FIG. 19, the modification acoustic signal of the extracted sound localized in the center of positions, which are the position of the L signal, the position of the C signal, and the position of the R signal, may be generated by performing weighted addition on the C signal, the SL signal, and the SR signal.

Stated differently, any method which can add, to the extracted sound, an effect of a sound around the extracted sound and connect the sound spatially smoothly may be used.

With the operations performed by the sound modification unit 301 described above, the sound separation device 300 can spatially smoothly connect the extracted sounds so as to avoid creation of a space where no sound is localized.

Other Embodiments

As above, Embodiments 1 and 2 are described as examples of a technique disclosed in this application. However, the technique according to the present disclosure is not limited to such examples, and is applicable to an embodiment which results from a modification, a replacement, an addition, or an omission as appropriate. Furthermore, it is also possible to combine respective structural elements described in the above-described Embodiment 1 and 2 to create a new embodiment.

Thus, the following collectively describes other embodiments.

For example, the sound separation devices described in Embodiment 1 and 2 may be partly or wholly realized by a circuit that is dedicated hardware, or realized as a program executed by a processor. More specifically, the following is also included in the present disclosure.

(1) More specifically, each device described above may be achieved by a computer system which includes a microprocessor, a ROM, a RAM, a hard disk unit, a display unit, a keyboard, a mouse, or the like. A computer program is stored in the RAM or the hard disk unit. The operation of the microprocessor in accordance with the computer program allows each device to achieve its functionality. Here, the computer program includes a combination of instruction codes indicating instructions to a computer in order to achieve given functionality.

(2) The structural elements included in each device described above may be partly or wholly realized by one system LSI (Large Scale Integration). A system LSI is a super-multifunction LSI manufactured with a plurality of structural units integrated on a single chip, and is specifically a computer system including a microprocessor, a ROM, a RAM, and so on. A computer program is stored in the ROM. The system LSI achieves its function as a result of the microprocessor loading the computer program from the ROM to the RAM and executing operations or the like according to the loaded computer program.

(3) The structural elements included in each device may be partly or wholly realized by an IC card or a single module that is removably connectable to the device. The IC card or the module is a computer system which includes a microprocessor, a ROM, a RAM, or the like. The IC card or the module may include the above-mentioned multi-multifunction LSI. Functions of the IC card or the module can be achieved as a result of the microprocessor operating in accordance with the computer program. The IC card or the module may be tamper resistant.

(4) The present disclosure may be achieved by the methods described above. Moreover, these methods may be achieved by a computer program implemented by a computer, or may be implemented by a digital signal of the computer program.

Moreover, the present disclosure may be achieved by a computer program or a digital signal stored in a computer-readable recording medium such as, a flexible disk, a hard disk, a CD-ROM, an MO, a DVD, a DVD-ROM, a DVD-RAM, a Blu-ray disc (BD), a semiconductor memory, or the like. Moreover, the present disclosure may be achieved by a digital signal stored in the above mentioned storage medium.

Moreover, the present disclosure may be the computer program or the digital signal transmitted via a network represented by an electric communication line, a wired or wireless communication line, or the Internet, or data broadcasting, or the like.

Moreover, the present disclosure may be a computer system which includes a microprocessor and a memory. In this case, the computer program can be stored in the memory, with the microprocessor operating in accordance with the computer program.

Furthermore, the program or digital signal may be recorded on the recording medium and thus transmitted, or the program or the digital signal may be transmitted via the network or the like, so that the present disclosure can be implemented by another independent computer system.

(5) The above embodiments and the above variations may be combined.

As above, the embodiments are described as examples of the technique according to the present disclosure. The accompanying drawings and detailed descriptions are provided for such a purpose.

Thus, the structural elements described in the accompanying drawings and the detailed descriptions include not only structural elements indispensable to solve a problem but may also include structural elements not necessarily indispensable to solve a problem to provide examples of the above-described technique. Therefore, structural elements not necessarily indispensable should not be immediately asserted to be indispensable for the reason that such structural elements are described in the accompanying drawings and the detailed descriptions.

Furthermore, above-described embodiments show examples of a technique according to the present disclosure. Thus, various modifications, replacements, additions, omissions, or the like can be made in the scope of CLAIMS or in a scope equivalent to the scope of CLAIMS.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

A sound separation device according to the present disclosure can accurately generate, using two acoustic signals, an acoustic signal of a sound localized between reproduction positions each corresponding to a different one of the two acoustic signals, and is applicable to an audio reproduction apparatus, a network audio apparatus, a portable audio apparatus, a disc player and a recorder for a Blu-ray Disc, a DVD, a hard disk, or the like, a television, a digital still camera, a digital video camera, a portable terminal device, a personal computer, or the like.

The invention claimed is:

1. A sound separation device comprising:

a processor and a memory device, the processor including a signal obtainment unit, a differential signal generation unit, an acoustic signal generation unit and an extraction unit;

the signal obtainment unit obtains a plurality of acoustic signals including a first acoustic signal and a second acoustic signal, the first acoustic signal representing a sound outputted from a first position, and the second acoustic signal representing a sound outputted from a second position;

the differential signal generation unit generates a differential signal which is a signal representing a difference in a time domain between the first acoustic signal and the second acoustic signal;

the acoustic signal generation unit generates, using at least one acoustic signal among the acoustic signals, a third acoustic signal including a component of a sound which is localized in a position between the first position and the second position by the sound outputted from the first position and the sound outputted from the second position; and the extraction unit generates a third frequency signal by subtracting, from a first frequency signal obtained by transforming the third acoustic signal into a frequency domain, a second frequency signal obtained by transforming the differential signal into a frequency domain, and generates a separated acoustic signal by transforming the generated third frequency signal into a time domain, the separated acoustic signal being an acoustic signal representing a sound localized in the position between the first position and the second position, the separated acoustic signal being output by the sound separation device.

2. The sound separation device according to claim 1, wherein when a distance from the position to the first position is shorter than a distance from the position to the second position, the acoustic signal generation unit utilizes the first acoustic signal as the third acoustic signal.

3. The sound separation device according to claim 1, wherein when a distance from the position to the second position is shorter than a distance from the position to the first position, the acoustic signal generation unit utilizes the second acoustic signal as the third acoustic signal.

4. The sound separation device according to claim 1, wherein the acoustic signal generation unit determines a first coefficient and a second coefficient, and generate the third acoustic signal by adding a signal obtained by multiplying the first acoustic signal by the first coefficient and a signal obtained by multiplying the second acoustic signal by the second coefficient, the first coefficient being a value which increases with a decrease in a distance from the position to the first position, and the second coefficient being a value which increases with a decrease in a distance from the position to the second position.

5. The sound separation device according to claim 1, wherein the differential signal generation unit generates the difference signal which is a difference in a time domain between a signal obtained by multiplying the first acoustic signal by a first weighting coefficient and a signal obtained by multiplying the second acoustic signal by a second weighting coefficient, and determine the first weighting coefficient and the second weighting coefficient so that a value obtained by dividing the second weighting coefficient by the first weighting coefficient increases with a decrease in a distance from the first position to the position.

6. The sound separation device according to claim 5, wherein a localization range of a sound outputted using the separated acoustic signal increases with a decrease in absolute values of the first weighting coefficient and the second weighting coefficient determined by the differential signal generation unit, and a localization range of a sound outputted using the separated acoustic signal decreases with an increase in absolute values of the first weighting coefficient and the second weighting coefficient determined by the differential signal generation unit.

7. The sound separation device according to claim 1, wherein the extraction unit generates the third frequency signal by using a subtracted value which is obtained for each frequency by subtracting a magnitude of the second frequency signal from a magnitude of the first frequency signal, and the subtracted value is replaced with a predetermined positive value when the subtracted value is a negative value.

8. The sound separation device according to claim 1, further comprising a sound modification unit generates a modification acoustic signal using at least one acoustic signal among the acoustic signals, and add the modification acoustic signal to the separated acoustic signal, the modification acoustic signal being for modifying the separated acoustic signal according to the position.

9. The sound separation device according to claim 8, wherein the sound modification unit determines a third coefficient and a fourth coefficient, and generate the modification acoustic signal by adding a signal obtained by multiplying the first acoustic signal by the third coefficient and a signal obtained by multiplying the second acoustic signal by the fourth coefficient, the third coefficient being a value which increases with a decrease in a distance from the position to the first position, and the fourth coefficient being a value which increases with a decrease in a distance from the position to the second position.

10. The sound separation device according to claim 1, wherein the first acoustic signal and the second acoustic signal form a stereo signal.

11. A sound separation method comprising:

obtaining a plurality of acoustic signals including a first acoustic signal and a second acoustic signal, the first acoustic signal representing a sound outputted from a first position, and the second acoustic signal representing a sound outputted from a second position;

generating a differential signal which is a signal representing a difference in a time domain between the first acoustic signal and the second acoustic signal;

generating, using at least one acoustic signal among the acoustic signals, a third acoustic signal including a component of a sound which is localized in a position between the first position and the second position by the sound outputted from the first position and the sound outputted from the second position; and generating a third frequency signal by subtracting, from a first frequency signal obtained by transforming the third acoustic signal into a frequency domain, a second frequency signal obtained by transforming the differential signal into a frequency domain, and generating a separated acoustic signal by transforming the generated third frequency signal into a time domain, the separated acoustic signal being an acoustic signal representing a sound localized in the position between the first position and the second position, the separated acoustic signal being output.

* * * * *